US010755660B2

(12) United States Patent
Mitsui et al.

(10) Patent No.: US 10,755,660 B2
(45) Date of Patent: Aug. 25, 2020

(54) DISPLAY DEVICE WITH A PLURALITY OF MEMORY SELECTION LINE GROUPS

(71) Applicant: Japan Display Inc., Tokyo (JP)

(72) Inventors: Masashi Mitsui, Tokyo (JP); Susumu Kimura, Tokyo (JP); Yutaka Mitsuzawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 36 days.

(21) Appl. No.: 16/157,291

(22) Filed: Oct. 11, 2018

(65) Prior Publication Data

US 2019/0114983 A1 Apr. 18, 2019

(30) Foreign Application Priority Data

Oct. 16, 2017 (JP) ..... 2017-200268

(51) Int. Cl.
*G09G 3/36* (2006.01)

(52) U.S. Cl.
CPC ..... *G09G 3/3677* (2013.01); *G09G 3/3688* (2013.01); *G09G 2300/0861* (2013.01)

(58) Field of Classification Search
CPC ..... G09G 3/3688; G09G 2300/0861; G09G 5/395
See application file for complete search history.

(56) References Cited

U.S. PATENT DOCUMENTS 5,945,972 A * 8/1999 Okumura ..... G09G 3/3648 345/100
2002/0018029 A1* 2/2002 Koyama ..... G09G 3/3275 345/39
2002/0021274 A1* 2/2002 Koyama ..... G09G 3/3266 345/98
2002/0089496 A1* 7/2002 Numao ..... G09G 3/3258 345/204
2002/0093472 A1* 7/2002 Numao ..... G09G 3/3258 345/87
2003/0142054 A1* 7/2003 Tada ..... G09G 3/3614 345/87
2004/0196235 A1* 10/2004 Koyama ..... G09G 3/3607 345/89
2005/0157539 A1* 7/2005 Van Der Zaag ..... G11C 11/16 365/158
2005/0230723 A1* 10/2005 Van Der Zaag ..... G09G 3/20 257/295
(Continued)

FOREIGN PATENT DOCUMENTS

JP 09-212140 A 8/1997

*Primary Examiner* — Alexander Eisen
*Assistant Examiner* — Nathaniel P Brittingham
(74) *Attorney, Agent, or Firm* — Michael Best & Friedrich LLP

(57) ABSTRACT

A display device includes an array of sub-pixels, each of which include a memory to store sub-pixel data. The display device also includes a plurality of memory selection line groups respectively corresponding to the sub-pixel memories in rows of the array. The memory selection line groups are operated under control of a memory selection circuit, which outputs a memory selection signal based on a set value, thereby to perform sequential switching of memory selection lines. The sequential switching of the memory selection lines results in a sequential switching of the image being displayed.

5 Claims, 17 Drawing Sheets

(56) References Cited

U.S. PATENT DOCUMENTS

2007/0063959 A1* 3/2007 Iwabuchi ..... G09G 3/2074 345/100
2007/0070026 A1* 3/2007 Cho ..... G09G 3/3413 345/102
2008/0231586 A1* 9/2008 Wang ..... G09G 3/3611 345/99
2009/0102751 A1* 4/2009 Takatoku ..... G09G 3/3659 345/55
2009/0141013 A1* 6/2009 Nagai ..... G09G 3/3659 345/211
2011/0069075 A1* 3/2011 Nurmi ..... G09G 3/3648 345/545
2012/0019436 A1* 1/2012 Yamashita ..... G09G 3/3225 345/76
2012/0099038 A1* 4/2012 Yoshiga ..... G02F 1/133371 349/33
2012/0188166 A1* 7/2012 Nurmi ..... G09G 3/3648 345/168
2013/0002626 A1* 1/2013 Washio ..... G09G 3/2085 345/205
2014/0015866 A1* 1/2014 Teranishi ..... G09G 3/2007 345/690
2014/0340383 A1* 11/2014 Gyouten ..... G09G 3/3696 345/212
2015/0364095 A1* 12/2015 Zhang ..... G09G 3/3426 345/690
2016/0162242 A1* 6/2016 Xiong ..... G06F 3/1431 345/5
2016/0372054 A1* 12/2016 Yamazaki ..... G09G 3/344
2017/0187976 A1* 6/2017 Cok ..... H04N 5/376
2017/0200407 A1* 7/2017 Nakao ..... G09G 3/2003
2018/0075823 A1* 3/2018 Nakao ..... G09G 5/395
2018/0191978 A1* 7/2018 Cok ..... G09G 3/3208
2018/0211615 A1* 7/2018 Tan ..... G02F 1/13306
2018/0308446 A1* 10/2018 Mitsuzawa ..... G09G 3/3677
2019/0005904 A1* 1/2019 Mitsuzawa ..... G09G 3/3688
2019/0066634 A1* 2/2019 Tamaki ..... G09G 3/3692
2019/0114983 A1* 4/2019 Mitsui ..... G09G 3/3688
2019/0197996 A1* 6/2019 Mitsuzawa ..... G09G 5/399

* cited by examiner

FIG.5

41

| Q | | WHERE TO OUTPUT MEMORY SELECTION SIGNAL |
|---|---|---|
| $Q_2$ | $Q_1$ | |
| 0 | 0 | $SEL_a$ |
| 0 | 1 | $SEL_b$ |
| 1 | 0 | $SEL_c$ |

FIG.14

42

| UPCT | DNCT | LD | CLR | OPERATION |
|---|---|---|---|---|
| ↓ | Hi-Z | 1 | 0 | COUNT UP |
| Hi-Z | ↓ | 1 | 0 | COUNT DOWN |
| X | X | 0 | 0 | LOAD |
| X | X | X | 1 | CLEAR |

FIG.15

43

| REG | OPERATION |
|---|---|
| 000 | MAINTAIN CURRENT STATE |
| 001 | SELECT FIRST MEMORY |
| 010 | SELECT SECOND MEMORY |
| 011 | SELECT THIRD MEMORY |
| 100 | COUNT UP |
| 101 | COUNT DOWN |
| 110 | ALTERNATELY REPEAT COUNTING UP AND COUNTING DOWN |
| 111 | CLEAR |

DISPLAY DEVICE WITH A PLURALITY OF MEMORY SELECTION LINE GROUPS

CROSS-REFERENCE TO RELATED APPLICATIONS

This application claims priority from Japanese Application No. 2017-200268, filed on Oct. 16, 2017, the contents of which are incorporated by reference herein in its entirety.

BACKGROUND

1. Technical Field

The present disclosure relates to a display device.

2. Description of the Related Art

A display device, which displays images, includes a plurality of pixels. Japanese Patent Application Laid-open Publication No. 09-212140 (JP-A-09-212140) discloses what is called a memory-in-pixel (MIP) type display device in which each pixel includes a memory. In the display device disclosed in JP-A-09-212140, each of the pixels includes a plurality of memories and a circuit that switches the memories from one to another.

In some case, it is desired that a display device display images in various modes, for example, display a certain image as a still image at a first timing, display a plurality of images in a first sequence as a moving image at a second timing, and display the plurality of images in a second sequence as a moving image at a third timing.

For the foregoing reasons, there is a need for a display device capable of displaying images in various modes.

SUMMARY

According to an aspect, a display device includes: a plurality of sub-pixels arranged in a row direction and a column direction and each including a memory block that includes a plurality of memories to store therein sub-pixel data; a plurality of memory selection line groups provided corresponding to a plurality of rows and each including a plurality of memory selection lines electrically coupled to the memory blocks in the respective sub-pixels that belong to the corresponding row; and a memory selection circuit configured to concurrently output a memory selection signal to the memory selection line groups, the memory selection signal being a signal for selecting one of the memories in each of the memory blocks. Based on a set value, the memory selection circuit selects one of the memory selection lines to be supplied with the memory selection signal in each of the memory selection line groups. Each of the sub-pixels displays an image based on the sub-pixel data stored in one of the memories in accordance with the memory selection line supplied with the memory selection signal. The number of times that the set value is changed is less than the number of times that images are switched from one to another based on the memory selection signal output from the memory selection circuit.

BRIEF DESCRIPTION OF THE DRAWINGS

FIG. 5 is a diagram illustrating a truth table of an output circuit of the display device of the embodiment;

FIG. 14 is a diagram illustrating a truth table of a ternary up-down counter of the display device of the embodiment;

FIG. 15 is a diagram illustrating a truth table of a counter controller of the display device of the embodiment;

DETAILED DESCRIPTION

Figure 1:
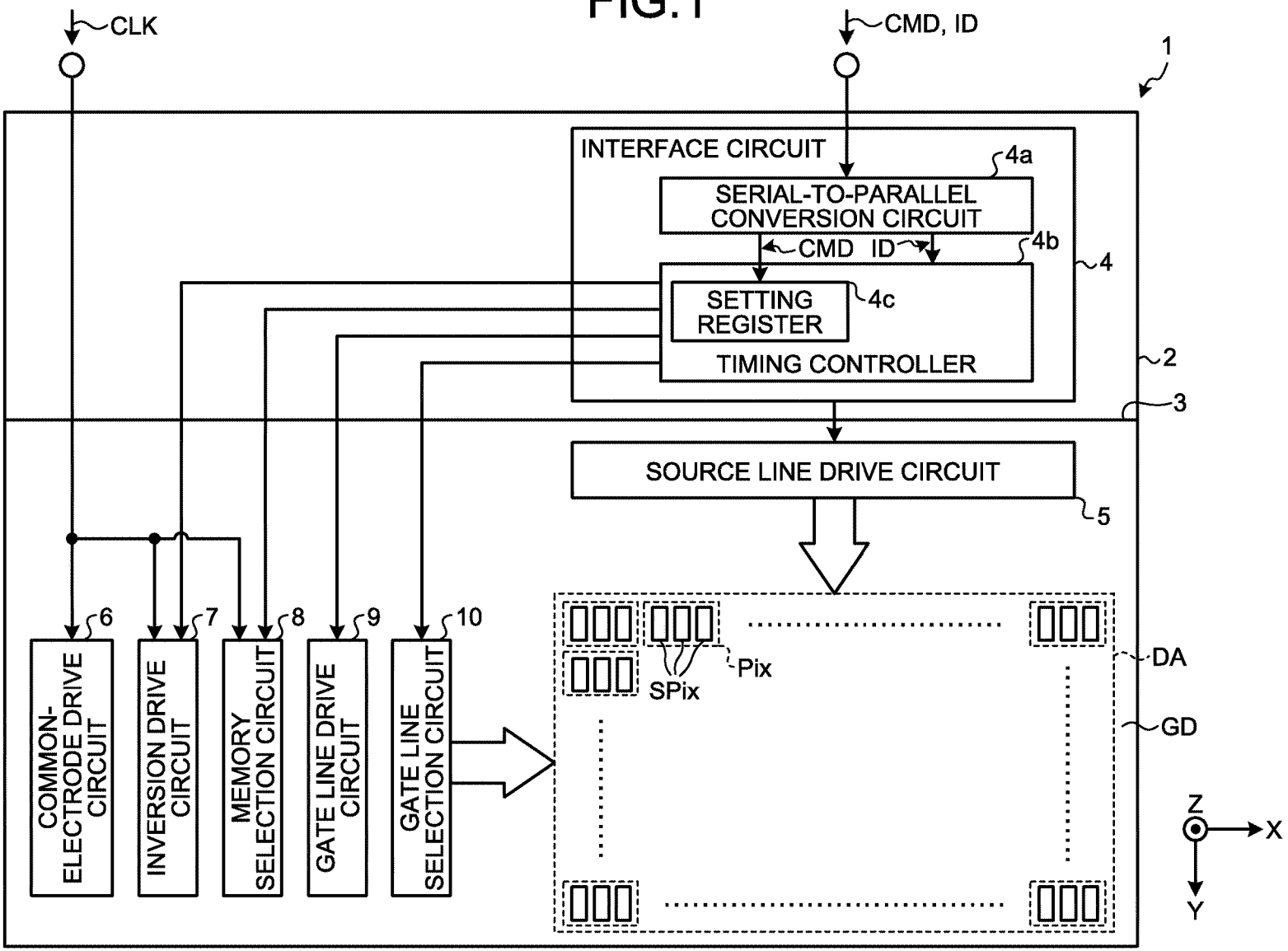
FIG. 1 is a diagram schematically illustrating an entire configuration of a display device of an embodiment.

Modes (embodiments) for carrying out the present invention are described hereinbelow in detail with reference to the drawings. Descriptions of the following embodiment are not intended to limit the present invention. The constituent elements described below include those readily apparent to the skilled person or substantially the same. Any two or more of the constituent elements described below can be combined as appropriate. What is disclosed herein is merely exemplary, and modifications made without departing from the spirit of the invention and readily apparent to the skilled person naturally fall within the scope of the present invention. The widths, the thicknesses, the shapes, or the like of certain devices in the drawings may be illustrated not-to-scale, for illustrative clarity, as compared with actual aspects. However, the drawings are merely exemplary and not intended to limit interpretation of the present invention. Throughout the description and the drawings, the same elements as those already described with reference to the drawing already referred to are assigned the same reference signs, and detailed descriptions thereof are omitted as appropriate.

In this disclosure, when an element is described as being "on" another element, the element can be directly on the other element, or there can be one or more elements between the element and the other element.

Embodiment

Entire Configuration

FIG. 1 schematically illustrates an entire configuration of a display device 1 in an embodiment. The display device 1 includes a first panel 2 and a second panel 3 disposed facing the first panel 2. The display device 1 has a display region DA on which images are displayed, and a frame region GD outside of the display region DA. In the display region DA, a liquid crystal layer is sealed between the first panel 2 and the second panel 3.

While the display device 1 is described as a liquid crystal display device including a liquid crystal layer in the embodiment, this disclosure is not limited to this example. The display device 1 may be an organic electro-luminescence (EL) display device including organic EL elements in place of a liquid crystal layer.

In the display region DA, a plurality of pixels Pix are disposed in a matrix of N columns (where N is a natural number) and M rows (where M is a natural number). The N columns are arranged in the X direction parallel to the respective principal planes of the first panel 2 and the second panel 3, and the M rows are arranged in the Y direction, which is parallel to the respective principal planes of the first panel 2 and the second panel 3 and intersects the X direction. In the frame region GD, an interface circuit 4, a source line drive circuit 5, a common-electrode drive circuit 6, an inversion drive circuit 7, a memory selection circuit 8, a gate line drive circuit 9, and a gate line selection circuit 10 are disposed. Another configuration can be employed in which, while the interface circuit 4, the source line drive circuit 5, the common-electrode drive circuit 6, the inversion drive circuit 7, the memory selection circuit 8 of the foregoing circuits are integrated into an integrated circuit (IC) chip, the gate line drive circuit 9 and the gate line selection circuit 10 are provided on the first panel 2. Still another configuration can be employed in which a group of such circuits integrated into an IC chip is provided in a processor external to a display device and is coupled to the display device.

Each of the M×N pixels Pix has a plurality of sub-pixels SPix. While these sub-pixels SPix are described as three pixels of R (red), G (green), and B (blue) in the embodiment, this disclosure is not limited to this example. These sub-pixels SPix may be four sub-pixels of colors including W (white) in addition to R (red), G (green), and B (blue). Alternatively, these sub-pixels SPix may be five or more sub-pixels of different colors.

In the embodiment, these sub-pixels SPix are three sub-pixels, and the total number of sub-pixels SPix disposed in the display region DA is accordingly M×N×3. In the embodiment, three sub-pixels SPix in each of the M×N pixels Pix are arranged in the X direction, and the total number of sub-pixels SPix disposed in any one of the rows included in the M×N pixels Pix is accordingly N×3.

Each of the sub-pixels SPix includes a plurality of memories. While these memories are described as three memories that are a first memory to a third memory in this embodiment, this disclosure is not limited to this example. These memories may be two memories or may be four or more memories.

In the embodiment, these memories are three memories, and the total number of memories disposed in the display region DA is accordingly M×N×3×3. In the embodiment, each of the sub-pixels SPix includes three memories, and the total number of memories disposed in any one of the rows included in the M×N pixels Pix is accordingly N×3×3.

Each of the sub-pixels SPix performs display based on sub-pixel data stored in one memory selected from the first memory, the second memory, and the third memory included in the sub-pixel SPix. That is, a set of M×N×3×3 memories included in the M×N×3 sub-pixels SPix is equivalent to three frame memories.

The interface circuit 4 includes a serial-to-parallel conversion circuit 4*a* and a timing controller 4*b*. The timing controller 4*b* includes a setting register 4*c*. The serial-to-parallel conversion circuit 4*a* is supplied with command data CMD and image data ID in a serial form from an external circuit. While the external circuit is exemplified by a host central processing unit (CPU) or an application processor, this disclosure is not limited to these examples.

The serial-to-parallel conversion circuit 4*a* converts the command data CMD supplied thereto into data in a parallel form and outputs the converted data to the setting register 4*c*. The setting register 4*c* has values therein set based on the command data CMD. The values are used for controlling the source line drive circuit 5, the inversion drive circuit 7, the memory selection circuit 8, the gate line drive circuit 9, and the gate line selection circuit 10.

The serial-to-parallel conversion circuit 4*a* converts the image data ID supplied thereto into data in a parallel form and outputs the converted data to the timing controller 4*b*. Based on the values that are set in the setting register 4*c*, the timing controller 4*b* outputs the image data ID to the source line drive circuit 5. Based on the values that are set in the setting register 4*c*, the timing controller 4*b* controls the inversion drive circuit 7, the memory selection circuit 8, the gate line drive circuit 9, and the gate line selection circuit 10.

The common-electrode drive circuit 6, the inversion drive circuit 7, and the memory selection circuit 8 are supplied with a reference clock signal CLK from an external circuit. While the external circuit is exemplified by a clock generator, this disclosure is not limited to this example.

It is well known that there are methods for preventing image burn-in on a screen of a liquid crystal display device, the methods including a common inversion driving method, a column inversion driving method, a line inversion driving method, a dot inversion driving method, and a frame inversion driving method.

The display device 1 can employ any one of the driving methods listed above. In the embodiment, the display device 1 employs a common inversion driving method. In the display device 1 that employs a common inversion driving method, the common-electrode drive circuit 6 inverts the potential (common potential) of a common electrode in synchronization with the reference clock signal CLK. Under the control of the timing controller 4*b*, the inversion drive circuit 7 inverts the potentials of sub-pixel electrodes in synchronization with the reference clock signal CLK. Thus, the display device 1 can implement a common inversion driving method. In the embodiment, the display device 1 is a normally-black liquid crystal display device that displays black when no voltage is applied to the liquid crystal and displays white when a voltage is applied to the liquid crystal. A normally-black liquid crystal display device displays black when the potential of the sub-pixel electrode and the common potential are in phase with each other, and displays white when the potential of the sub-pixel electrode and the common potential are not in phase with each other.

The reference clock signal CLK is an example of a referential signal in this disclosure.

In order to display an image on the display device, it is necessary to have the sub-pixel data stored in the first to third memories in each of the sub-pixels SPix. Under the control of the timing controller 4*b*, the gate line drive circuit 9 outputs a gate signal for selecting one of the rows included in the M×N pixels Pix so that the sub-pixel data can be stored in these individual memories.

In an MIP-type liquid crystal display device in which each sub-pixel includes one memory, one gate line is disposed for each row (pixel row (sub-pixel row)). In the embodiment, however, each of the sub-pixels SPix includes three memories that are the first memory to the third memory. For this reason, three gate lines are disposed for each row in the embodiment. The respective three gate lines are electrically coupled to the first memory to the third memory in each of the sub-pixels SPix included in the one row. In a configuration such that each of the sub-pixels SPix is configured to operate in accordance with a gate signal and an inverted gate signal obtained by inverting the gate signal, six gate lines are disposed for each row.

The three or six gate lines disposed for each row correspond to a gate line group. In the embodiment, the display device 1 includes M rows of pixels Pix, and M gate line groups are accordingly disposed.

The gate line drive circuit 9 includes M output terminals corresponding to the M rows of pixels Pix. Under the control of the timing controller 4*b*, the gate line drive circuit 9 sequentially outputs, from the M output terminals, the gate signal serving as a signal for selecting one of the M rows.

Under the control of the timing controller 4*b*, the gate line selection circuit 10 selects one of the three gate lines disposed for each row. Thus, the gate signal output from the gate line drive circuit 9 is supplied to the selected one of the three gate lines disposed for the row.

Under the control of the timing controller 4*b*, the source line drive circuit 5 outputs the sub-pixel data to memories selected in accordance with the gate signal. Thus, the corresponding sub-pixel data are sequentially stored in the first memory to the third memory in each of the sub-pixels.

The display device 1 performs line sequential scanning on the pixels Pix in the M rows, so that a plurality of pieces of the sub-pixel data that form frame data for one frame are stored in the respective first memories in the sub-pixels SPix. The display device 1 performs line sequential scanning three times to have the frame data for three frames stored in the first memory to the third memory in each of the sub-pixels SPix.

For the same effect, the display device 1 can alternatively employ another procedure in which corresponding data are written into the first memories, into the second memories, and into the third memories when each of the rows is scanned. When this scanning is performed on the individual first to M-th rows, the sub-pixel data in the first memories to the third memories in the sub-pixels SPix can be stored through line sequential scanning performed only one time.

In the embodiment, three memory selection lines are disposed for each row. The three memory selection lines are electrically coupled to the first to third memories, respectively, in each of N×3 sub-pixels SPix included in the one row. In a configuration such that each of the sub-pixels SPix is configured to operate in accordance with a memory selection signal and an inverted memory selection signal obtained by inverting the memory selection signal, six memory selection lines are disposed for each row.

The three or six memory selection lines disposed for each row correspond to a memory selection line group in the disclosure. In the embodiment, the display device 1 includes the pixels Pix disposed in M rows, and M memory selection line groups are accordingly disposed.

Under the control of the timing controller 4*b*, the memory selection circuit 8 concurrently selects the first memories, the second memories, or the third memories in the respective sub-pixels SPix in synchronization with the reference clock signal CLK. More specifically, the first memories in all of the sub-pixels SPix are concurrently selected. Otherwise, the second memories in all of the sub-pixels SPix are concurrently selected. Otherwise, the third memories in all of the sub-pixels SPix are concurrently selected. Consequently, the display device 1 can display one among three images by switching selection of a memory from one to another among the first memory to the third memory in each of the sub-pixels SPix. Thus, the display device 1 can change images all together and can quickly change images. The display device 1 enables animation display (moving image display) by sequentially switching selection of a memory from one to another among the first memory to the third memory in each of the sub-pixels SPix.

Sectional Structure

Figure 2:
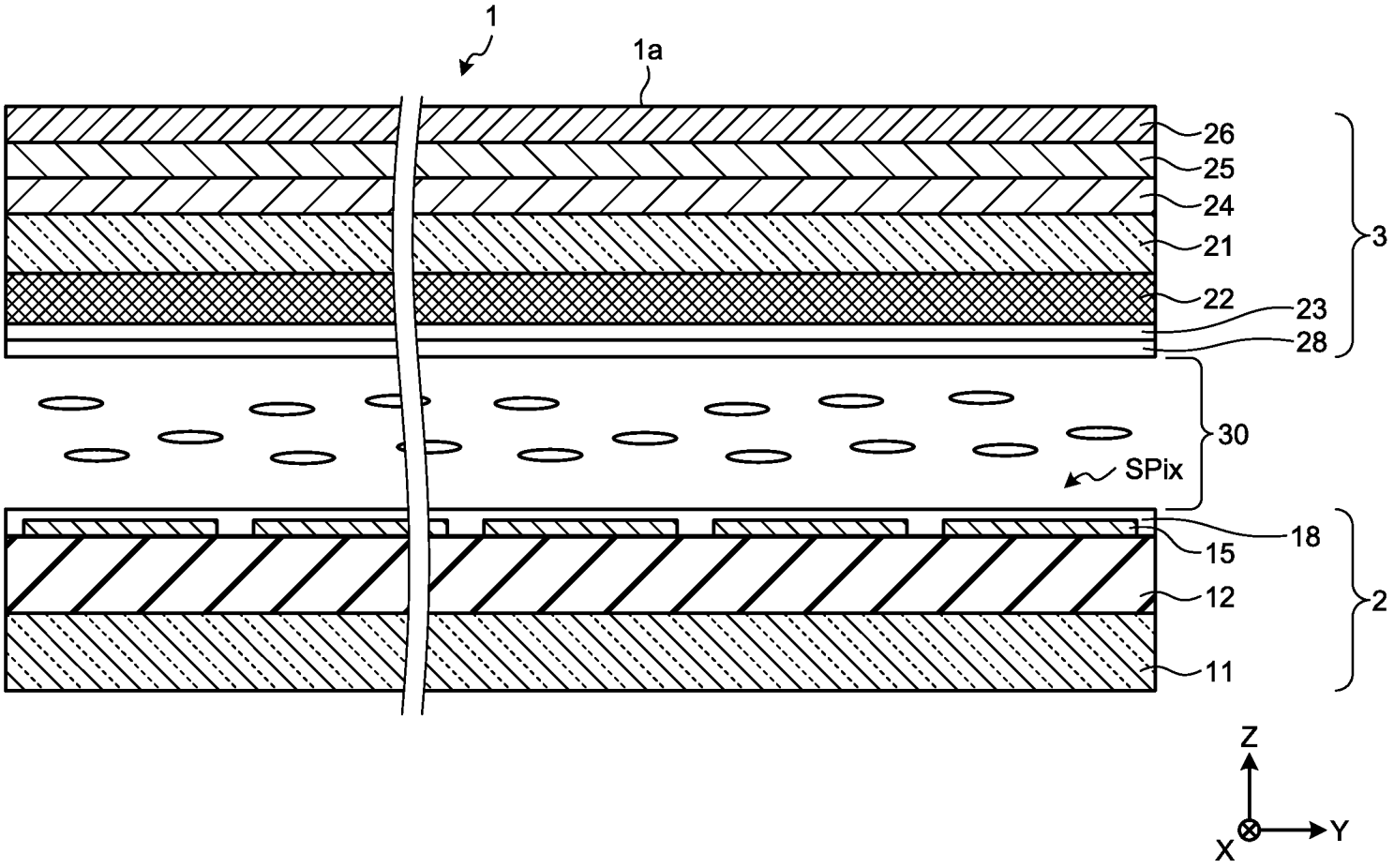
FIG. 2 is a sectional diagram of the display device of the embodiment.

FIG. 2 is a schematic diagram of a sectional structure of the display device 1 in the embodiment. As illustrated in FIG. 2, the display device 1 includes the first panel 2, the second panel 3, and a liquid crystal layer 30. The second panel 3 is disposed facing the first panel 2. The liquid crystal layer 30 is interposed between the first panel 2 and the second panel 3. One surface of the second panel 3 that constitutes the principal plane thereof is a display surface 1*a* for displaying an image thereon.

Light incident on the display surface 1*a* from the outside thereof is reflected by reflective electrodes 15 in the first panel 2 and exits from the display surface 1*a*. The display device 1 in the embodiment is a reflective liquid crystal display device that displays an image on the display surface 1*a* using this reflected light. In the present description, one direction parallel to the display surface 1*a* is set as the X direction, and a direction extending on a plane parallel to the display surface 1*a* and intersecting the X direction is set as the Y direction. A direction perpendicular to the display surface 1*a* is set as the Z direction.

The first panel 2 includes a first substrate 11, an insulating layer 12, the reflective electrodes 15, and an orientation film 18. The first substrate 11 is exemplified by a glass substrate or a resin substrate. On a surface of the first substrate 11, circuit elements and wiring of various kinds such as gate lines and data lines are mounted, which are not illustrated. Switching elements such as thin film transistors (TFTs) and capacitive elements are included in the circuit elements.

The insulating layer 12 is disposed on the first substrate 11, and serves to provide a flush surface all over the surfaces of the circuit elements and the wiring of various kinds. The plurality of reflective electrodes 15 are disposed on the insulating layers 12. The orientation film 18 is interposed between the reflective electrodes 15 and the liquid crystal layer 30. The reflective electrodes 15 each having a rectangular shape are provided corresponding to the sub-pixels SPix. The reflective electrodes 15 are formed of metal exemplified by aluminum (Al) or silver (Ag). The reflective electrodes 15 may have a configuration stacked with such a metal material and a translucent conductive material exemplified by indium tin oxide (ITO). The reflective electrodes 15 are formed of a material having favorable reflectance, thereby functioning as a reflective plate that reflects light incident from the outside.

After being reflected by the reflective electrodes 15, the light travels in a uniform direction toward the display surface 1*a* although being diffusely reflected and scattered. Change in level of voltage applied to each of the reflective electrodes 15 causes change in the state of light transmission through the liquid crystal layer 30 on the reflective electrode 15, that is, the state of light transmission of the corresponding sub-pixel. In other words, the respective reflective electrodes 15 also function as sub-pixel electrodes.

The second panel 3 includes a second substrate 21, a color filter 22, a common electrode 23, an orientation film 28, a quarter wavelength plate 24, a half wavelength plate 25, and a polarization plate 26. The color filter 22 and the common electrode 23 are disposed in this order on one of the two opposite surfaces of the second substrate 21, the one surface facing the first panel 2. The orientation film 28 is interposed between the common electrode 23 and the liquid crystal layer 30. The quarter wavelength plate 24, the half wavelength plate 25, and the polarization plate 26 are stacked in this order on a surface of the second substrate 21, the surface facing the display surface 1*a*.

The second substrate 21 is exemplified by a glass substrate or a resin substrate. The common electrode 23 is formed of a translucent conductive material exemplified by ITO. The common electrode 23 is disposed facing the reflective electrodes 15 and supplies a common potential to the sub-pixels SPix. While the color filter 22 is exemplified as including filters for three colors of R (red), G (green), and B (blue), this disclosure is not limited to this example.

The liquid crystal layer 30 is exemplified as containing nematic liquid crystal. In the liquid crystal layer 30, how liquid crystal molecules are oriented is changed when the voltage level between the common electrode 23 and each of the reflective electrodes 15 is changed. Light transmitted through the liquid crystal layer 30 is thus modulated on a sub-pixel SPix basis.

Ambient light or the like serves as incident light that is incident on the display surface 1*a* of the display device 1, and reaches the reflective electrodes 15 after being transmitted through the second panel 3 and the liquid crystal layer 30. The incident light is reflected by the reflective electrodes 15 for the respective sub-pixels SPix. The thus-reflected light is modulated on a sub-pixel SPix basis and exits from the display surface 1*a*. An image is thereby displayed.

Circuit Configuration

Figure 3:
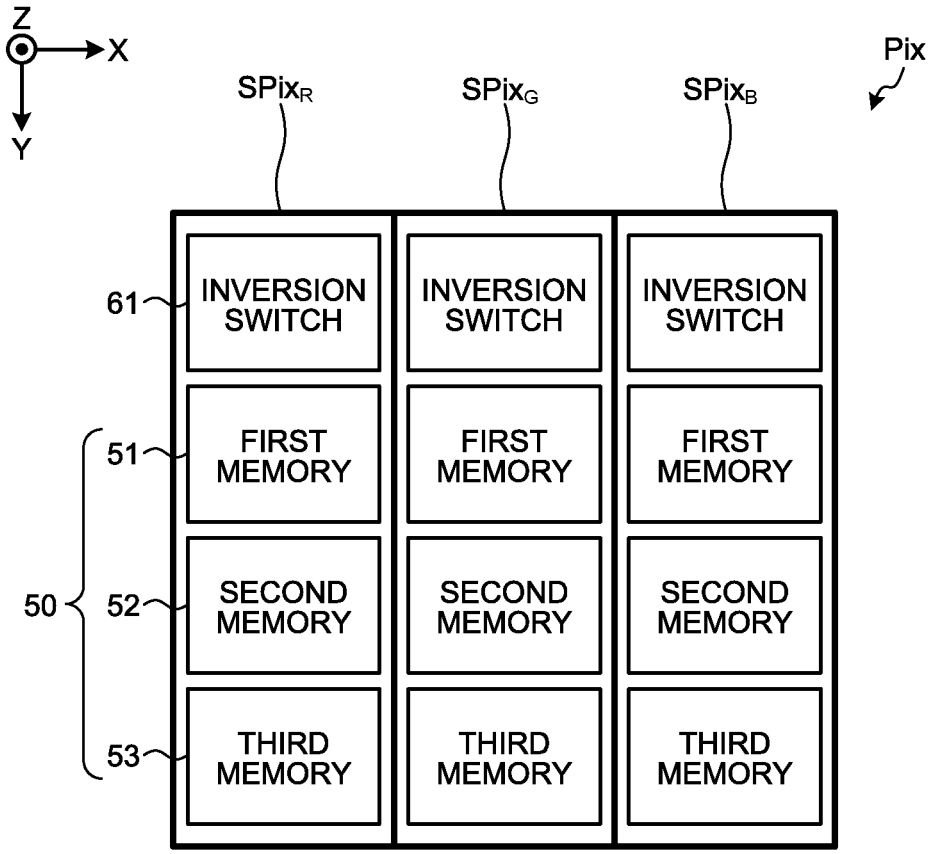
FIG. 3 is a diagram illustrating an arrangement of sub-pixels in a pixel of the display device of the embodiment.

FIG. 3 illustrates an arrangement of sub-pixels SPix in each pixel Pix of the display device 1 in the embodiment. The pixel Pix includes the sub-pixel $SPix_R$ for R (red), the sub-pixel $SPix_G$ for G (green), and the sub-pixel $SPix_E$ for B (blue). The sub-pixels $SPix_R$, $SPix_G$, and $SPix_E$ are arranged in the X direction.

The sub-pixel $SPix_R$ includes a memory block 50 and an inversion switch 61. The memory block 50 includes a first memory 51, a second memory 52, and a third memory 53. The inversion switch 61, the first memory 51, the second memory 52, and the third memory 53 are arranged in the Y direction.

While the first memory 51, the second memory 52, and the third memory 53 are each described herein as a memory cell that stores therein one-bit data, this disclosure is not limited to this example. Each of the first memory 51, the second memory 52, and the third memory 53 may be a memory cell that stores therein data of two or more bits.

The inversion switch 61 is electrically coupled to between the sub-pixel electrode (reflective electrode) 15 (see FIG. 2) and the first, second, and third memories 51, 52, and 53. Based on a display signal supplied from the inversion drive circuit 7 and inverting in synchronization with the reference clock signal CLK, the inversion switch 61 inverts the sub-pixel data output from a selected one of the first memory 51, the second memory 52, and the third memory 53 on a certain cycle, and outputs the inverted sub-pixel data to the sub-pixel electrode 15.

The display signal inverts in the same cycle as a cycle in which the potential (common potential) of the common electrode 23 inverts.

The inversion switch 61 is an example of a switch circuit in this disclosure.

Figure 4:
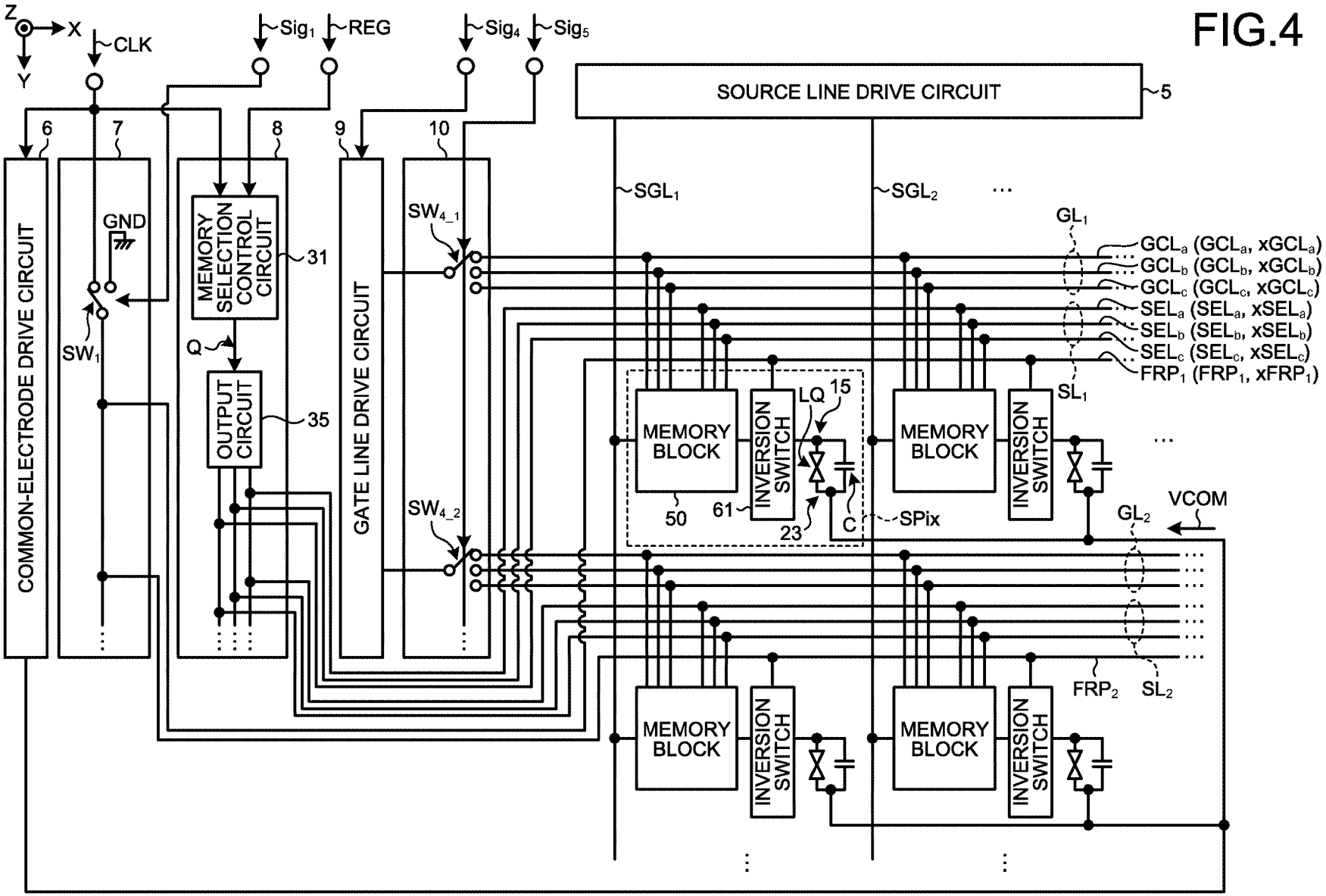
FIG. 4 is a diagram illustrating a circuit configuration of the display device of the embodiment.

FIG. 4 illustrates a circuit configuration of the display device 1 in the embodiment. FIG. 4 illustrates the sub-pixels SPix in a 2-by-2 matrix among the sub-pixels SPix.

Each of the sub-pixels SPix includes, in addition to the memory block 50 and the inversion switch 61, liquid crystal LQ, a holding capacitance C, and the sub-pixel electrode 15 (see FIG. 2).

The common-electrode drive circuit 6 inverts a common potential VCOM common to the sub-pixels SPix in synchronization with the reference clock signal CLK, and outputs the thus inverted common potential VCOM to the common electrode 23 (see FIG. 2). The common-electrode drive circuit 6 may output the reference clock signal CLK as it is, as the common potential VCOM, to the common electrode 23. The common-electrode drive circuit 6 may output the reference clock signal CLK as the common potential VCOM to the common electrode 23 via a buffer circuit that amplifies a current driving capability.

On the first panel 2, M display signal lines $FRP_1$, $FRP_2$, . . . are disposed corresponding to the M rows of pixels Pix. Each of the M display signal lines $FRP_1$, $FRP_2$, . . . extends in the X direction within the display region DA (see FIG. 1). In a configuration such that the inversion switch 61 operates based not only on a display signal but also on an inverted display signal obtained by inverting the display signal, the display signal line FRP and the second display signal line xFRP are disposed for each row.

Each of the one or two display signal lines disposed with respect to each one row corresponds to a display signal line of the present disclosure.

The inversion drive circuit 7 includes a switch $SW_1$. The switch $SW_1$ is controlled by a control signal $Sig_1$ supplied from the timing controller 4*b*. The switch $SW_1$ supplies the reference clock signal CLK to the display signal lines $FRP_1$, $FRP_2$, . . . if the control signal $Sig_1$ indicates the first value. The potential of the reflective electrodes 15 is thereby inverted in synchronization with the reference clock signal CLK. The switch $SW_1$ supplies the reference potential (ground potential) GND to the display signal lines $FRP_1$, $FRP_2$, . . . if the control signal $Sig_1$ indicates the second value.

The gate line drive circuit 9 includes M output terminals corresponding to the M rows of pixels Pix. Based on a control signal $Sig_4$ supplied from the timing controller 4*b*, the gate line drive circuit 9 sequentially outputs the gate signal from the M output terminals, the gate signal serving as a signal for selecting one of the M rows.

The gate line drive circuit 9 may be a scanner circuit configured to sequentially output the gate signal from M output terminals based on control signals $Sig_4$ (a scan start signal and a clock pulse signal). Alternatively, the gate line drive circuit 9 may be a decoder circuit configured to decode the control signal $Sig_4$ that has been encoded and output the gate signal to an output terminal designated by the control signal $Sig_4$.

The gate line selection circuit 10 includes M switches $SW_{41}$, $SW_{42}$, . . . corresponding to the M rows of pixels Pix.

The M switches $SW_{41}$, $SW_{42}$, . . . are controlled in accordance with a control signal $Sig_5$ supplied from the timing controller 4*b*.

On the first panel 2, M gate line groups $GL_1$, $GL_2$, . . . are disposed corresponding to the pixels Pix in the respective M rows. Each of the M gate line groups $GL_1$, $GL_2$, . . . includes a first gate line $GCL_a$, a second gate line $GCL_b$, and a third gate line $GCL_c$. The first gate line $GCL_a$ is electrically coupled to the first memories 51 (see FIG. 3) of its corresponding row, the second gate line $GCL_b$ is electrically coupled to the second memories 52 (see FIG. 3) thereof, and the third gate line $GCL_c$ is electrically coupled to the third memories 53 (see FIG. 3) thereof. Each of the M gate line groups $GL_1$, $GL_2$, . . . is parallel to the X direction in the display region DA (see FIG. 1).

Each of the M switches $SW_{4_1}$, $SW_{4_2}$, . . . electrically couples the corresponding output terminal of the gate line drive circuit 9 to the corresponding first gate line $GCL_a$ if the control signal $Sig_5$ indicates a first value. Each of the M switches $SW_{4_1}$, $SW_{4_2}$, . . . electrically couples the corresponding output terminal of the gate line drive circuit 9 to the corresponding second gate line $GCL_b$ if the control signal $Sig_5$ indicates a second value. Each of the M switches $SW_{4_1}$, $SW_{4_2}$, . . . electrically couples the corresponding output terminal of the gate line drive circuit 9 to the corresponding third gate line $GCL_c$ if the control signal $Sig_5$ indicates a third value.

When the output terminal of the gate line drive circuit 9 and the corresponding first gate line $GCL_a$ are electrically coupled together, the gate signal is supplied to the first memories 51 of the corresponding sub-pixels SPix. When the output terminal of the gate line drive circuit 9 and the corresponding second gate line $GCL_b$ are electrically coupled together, the gate signal is supplied to the second memories 52 of the corresponding sub-pixels SPix. When the output terminal of the gate line drive circuit 9 and the corresponding third gate line $GCL_c$ are electrically coupled together, the gate signal is supplied to the third memories 53 of the corresponding sub-pixels SPix.

On the first panel 2, N×3 source lines $SGL_1$, $SGL_2$, . . . are disposed corresponding to the N×3 columns of sub-pixels SPix. Each of the source lines $SGL_1$, $SGL_2$, . . . is parallel to the Y direction in the display region DA (see FIG. 1). The source line drive circuit 5 outputs the sub-pixel data to one of the three memories in each of the sub-pixels SPix through a corresponding one of the source lines $SGL_1$, $SGL_2$, . . . , the one memory having been selected by being supplied with the gate signal.

In accordance with the gate line GCL supplied with gate signal, each of the sub-pixels SPix that belong to one row supplied with a gate signal stores sub-pixel data in one memory among the first memory 51 to the third memory 53 therein, the sub-pixel data having been supplied through the corresponding source line SGL.

On the first panel 2, M memory selection line groups $SL_1$, $SL_2$, . . . are disposed corresponding to the M rows of pixels Pix. Each of the M memory selection line group $SL_1$, $SL_2$, . . . includes a first memory selection line $SEL_a$, a second memory selection line $SEL_b$, and a third memory selection line $SEL_c$. The first memory selection line $SEL_a$ is electrically coupled to the first memories 51 of the corresponding row, the second memory selection line $SEL_b$ is electrically coupled to the second memories 52 thereof, and a third memory selection line $SEL_c$ is electrically coupled to the third memories 53 thereof. Each of the M memory selection line groups $SL_1$, $SL_2$, . . . is parallel to the X direction in the display region DA (see FIG. 1).

The memory selection circuit 8 includes a memory selection control circuit 31 and an output circuit 35. The memory selection control circuit 31 is controlled by a memory selection control value REG supplied from the timing controller 4*b*. The memory selection control value REG is the value of a field for memory selection in the setting register 4*c*. While the memory selection control value REG is 3-bit wide in the embodiment, this disclosure is not limited to this specific example.

The memory selection control value REG corresponds to a set value of this disclosure.

The following describes operation to be performed when an image is displayed, that is, operation to be performed when an image is read out from the M×N×3 first memories 51, the M×N×3 second memories 52, or the M×N×3 third memories 53. In this case, the timing controller 4*b* outputs the memory selection control value REG to the memory selection control circuit 31. The memory selection control circuit 31 outputs a memory selection control signal Q to the output circuit 35 based on the memory selection control value REG supplied from the timing controller 4*b*. While the memory selection control signal Q is described in the embodiment as being composed of a high-order bit $Q_2$ and a low-order bit $Q_1$ and being 2-bit wide, the present disclosure is not limited to this specific example. Based on the memory selection control signal Q, the output circuit 35 outputs the memory selection signal to the first memory selection line $SEL_a$, the second memory selection line $SEL_b$, or the third memories $SEL_c$ of each of the M memory selection line groups $SL_1$, $SL_2$, . . . .

Each of the M×N sub-pixels SPix displays an image (frame) based on the sub-pixel data stored in one memory among the first memory 51 to the third memory 53, the one memory corresponding to the memory selection line SEL to which the memory selection signal is supplied.

Next, the output circuit 35 is described, and the memory selection control circuit 31 is described later.

FIG. 5 is a diagram illustrating a truth table of the output circuit of the display device of the embodiment.

The first row of a truth table 41 indicates how the output circuit 35 operates when the memory selection control signal Q is "0b00". In this case, the output circuit 35 outputs the memory selection signal to the first memory selection line $SEL_a$. Each of the sub-pixels SPix displays an image based on the sub-pixel data stored in the first memory 51 when the memory selection signal is supplied to the first memory selection line $SEL_a$.

The second row of the truth table 41 indicates how the output circuit 35 operates when the memory selection control signal Q is "0b01". In this case, the output circuit 35 outputs the memory selection signal to the second memory selection line $SEL_b$. Each of the sub-pixels SPix displays an image based on the sub-pixel data stored in the second memory 52 when the memory selection signal is supplied to the second memory selection line $SEL_b$.

The third row of the truth table 41 indicates how the output circuit 35 operates when the memory selection control signal Q is "0b10". In this case, the output circuit 35 outputs the memory selection signal to the third memory selection line $SEL_c$. Each of the sub-pixels SPix displays an image based on the sub-pixel data stored in the third memory 53 when the memory selection signal is supplied to the third memory selection line $SEL_c$.

Figure 6:
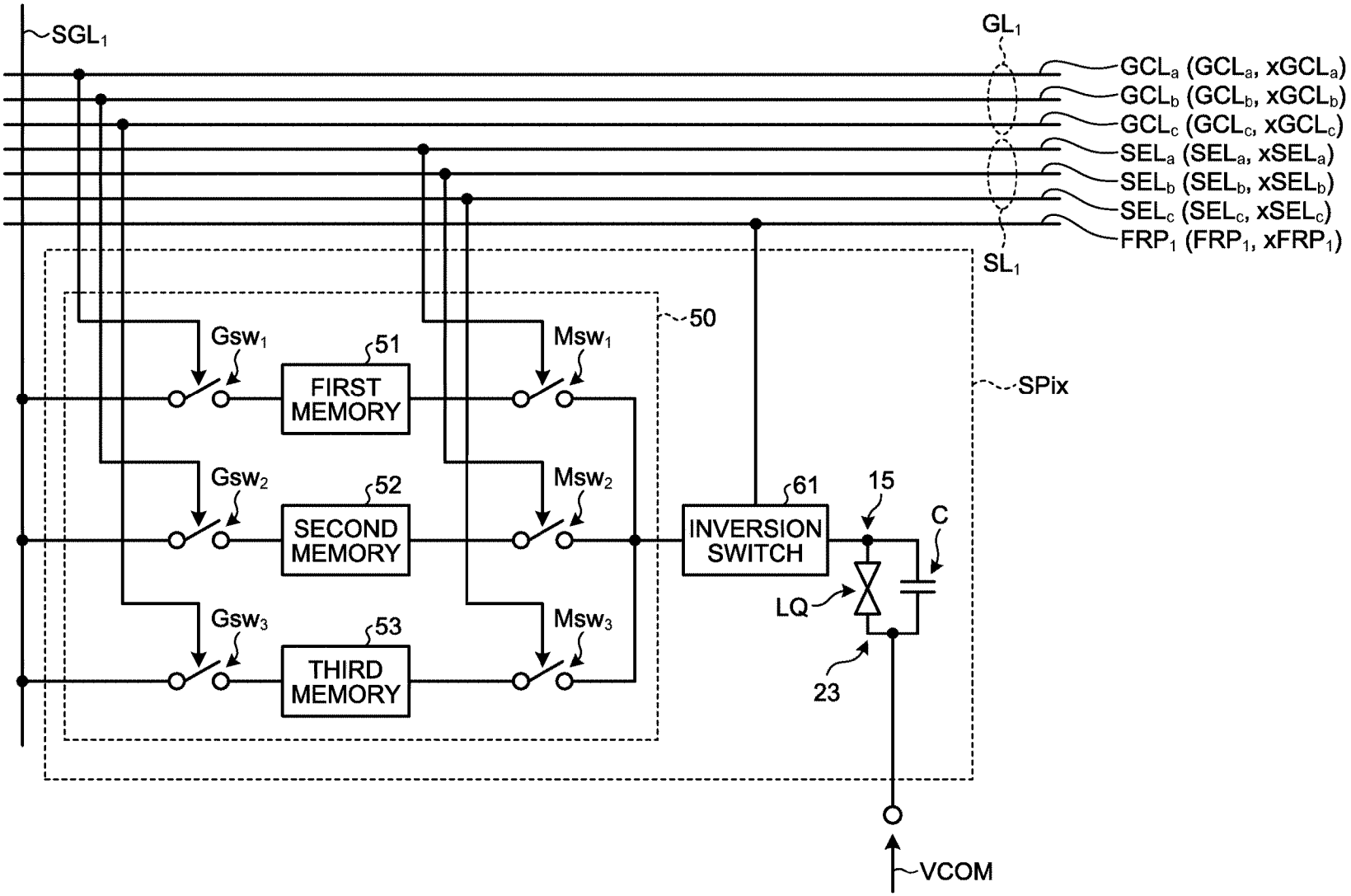
FIG. 6 is a diagram illustrating a circuit configuration of each sub-pixel of the display device of the embodiment.

FIG. 6 illustrates a circuit configuration of the sub-pixel SPix of the display device 1 in the first embodiment. FIG. 6 illustrates one of the sub-pixels SPix.

The sub-pixel SPix includes the memory block 50. The memory block 50 includes the first memory 51, the second memory 52, the third memory 53, switches $Gsw_1$ to $Gsw_3$, and switches $Msw_1$ to $Msw_3$.

A control input terminal of the switch $Gsw_1$ is electrically coupled to the first gate line $GCL_a$. When a high-level gate signal is supplied to the first gate line $GCL_a$, the switch $Gsw_1$ is turned on to electrically couple the source line $SGL_1$ to an input terminal of the first memory 51. Thus, the sub-pixel data supplied to the source line $SGL_1$ is stored in the first memory 51.

A control input terminal of the switch $Gsw_2$ is electrically coupled to the second gate line $GCL_b$. When a high-level gate signal is supplied to the second gate line $GCL_b$, the switch $Gsw_2$ is turned on to electrically couple the source line $SGL_1$ to an input terminal of the second memory 52. Thus, the sub-pixel data supplied to the source line $SGL_1$ is stored in the second memory 52.

A control input terminal of the switch $Gsw_3$ is electrically coupled to the third gate line $GCL_c$. When a high-level gate signal is supplied to the third gate line $GCL_c$, the switch $Gsw_3$ is turned on to electrically couple the source line $SGL_1$ to an input terminal of the third memory 53. Thus, the sub-pixel data supplied to the source line $SGL_1$ is stored in the third memory 53.

In a configuration such that the switches $Gsw_1$ to $Gsw_3$ each operate with a high-level gate signal, the gate line group $GL_1$ includes the first gate line $GCL_a$ to the third gate line $GCL_c$ as illustrated in FIG. 5. While a switch that operates based on a high-level gate signal is exemplified by an N-channel transistor, the present disclosure is not limited thereto.

In a configuration such that each of the switches $Gsw_1$ to $Gsw_3$ operates based not only on the gate signal but also on the inverted gate signal obtained by inverting the gate signal, the gate line group $GL_1$ includes not only the first gate line $GCL_a$ to the third gate line $GCL_c$ but also fourth gate line $xGCL_a$ to sixth gate line $xGCL_c$ to each of which the inverted gate signal is supplied. While a switch that operates based on the gate signal and the inverted gate signal is exemplified by a transfer gate, the present disclosure is not limited thereto.

The inverted gate signal can be supplied to the fourth gate line $xGCL_a$ when the display device 1 includes an inverter circuit including an input terminal electrically coupled to the first gate line $GCL_a$ and an output terminal electrically coupled to the fourth gate line $xGCL_a$. Likewise, the inverted gate signal can be supplied to the fifth gate line $xGCL_b$ when the display device 1 includes an inverter circuit including an input terminal electrically coupled to the second gate line $GCL_b$ and an output terminal electrically coupled to the fifth gate line $xGCL_b$. Likewise, the inverted gate signal can be supplied to the sixth gate line $xGCL_c$ when the display device 1 includes an inverter circuit including an input terminal electrically coupled to the third gate line $GCL_c$ and an output terminal electrically coupled to the sixth gate line $xGCL_c$.

A control input terminal of the switch $Msw_1$ is electrically coupled to the first memory selection line $SEL_a$. When a high-level memory selection signal is supplied to the first memory selection line $SEL_a$, the switch $Msw_1$ is turned on and electrically couples the output terminal of the first memory 51 to an input terminal of the inversion switch 61. Thus, the sub-pixel data stored in the first memory 51 is supplied to the inversion switch 61.

A control input terminal of the switch $Msw_2$ is electrically coupled to the second memory selection line $SEL_b$. When a high-level memory selection signal is supplied to the second memory selection line $SEL_b$, the switch $Msw_2$ is turned on and electrically couples the output terminal of the second memory 52 to the input terminal of the inversion switch 61. Thus, the sub-pixel data stored in the second memory 52 is supplied to the inversion switch 61.

A control input terminal of the switch $Msw_3$ is electrically coupled to the third memory selection line $SEL_c$. When a high-level memory selection signal is supplied to the third memory selection line $SEL_c$, the switch $Msw_3$ is turned on and electrically couples the output terminal of the third memory 53 to the input terminal of the inversion switch 61. Thus, the sub-pixel data stored in the third memory 53 is supplied to the inversion switch 61.

In a configuration such that each of the switches $Msw_1$ to $Msw_3$ operates based on a high-level memory selection signal, the memory selection line group $SL_1$ includes the first memory selection line $SEL_a$ to the third memory selection line $SEL_c$ as illustrated in FIG. 6. While a switch that operates based on a high-level gate signal is exemplified by an N-channel transistor, the present disclosure is not limited thereto.

In a configuration such that each of the switches $Msw_1$ to $Msw_3$ operates based not only on the memory selection signal but also on the inverted memory selection signal obtained by inverting the memory selection signal, the memory selection line group $SL_1$ includes not only the first memory selection line $SEL_a$ to the third memory selection line $SEL_c$ but also fourth memory selection line $xSEL_a$ to sixth memory selection line $xSEL_c$ to each of which the inverted memory selection signal is supplied. While a switch that operates based on the memory selection signal and the inverted memory selection signal is exemplified by a transfer gate, the present disclosure is not limited thereto.

The inverted memory selection signal can be supplied to the fourth memory selection line $xSEL_a$ when the display device 1 includes an inverter circuit having an input terminal electrically coupled to the first memory selection line $SEL_a$ and an output terminal electrically coupled to the fourth memory selection line $xSEL_a$. Likewise, the inverted memory selection signal can be supplied to the fifth memory selection line $xSEL_b$ when the display device 1 includes an inverter circuit having an input terminal electrically coupled to the second memory selection line $SEL_b$ and an output terminal electrically coupled to the fifth memory selection line $xSEL_b$. Likewise, the inverted memory selection signal can be supplied to the sixth memory selection line $xSEL_c$ when the display device 1 includes an inverter circuit having an input terminal electrically coupled to the third memory selection line $SEL_c$ and an output terminal electrically coupled to the sixth memory selection line $xSEL_c$.

A display signal that inverts in synchronization with the reference clock signal CLK is supplied to the inversion switch 61 from a display signal line $FRP_1$. Based on the display signal, the inversion switch 61 supplies the sub-pixel electrode 15 with the sub-pixel data stored in the first memory 51, the second memory 52, and the third memory 53 as it is or after inverting it. The liquid crystal LQ and the holding capacitance C are interposed between the sub-pixel electrode 15 and the common electrode 23. The holding capacitance C holds the voltage between the sub-pixel electrode 15 and the common electrode 23. Liquid crystal molecules in the liquid crystal LQ change in orientation based on the voltage between the sub-pixel electrode 15 and the common electrode 23, so that a sub-pixel image is displayed.

In a configuration such that the inversion switch 61 operates based on a display signal, the single display signal line $FRP_1$ is included as illustrated in FIG. 6. In contrast, in a configuration such that the inversion switch 61 operates based not only on the display signal but also on the inverted display signal obtained by inverting the display signal, a second display signal line $xFRP_1$ is included in addition to the display signal line $FRP_1$. Further, the display device 1 includes an inverter circuit including an input terminal electrically coupled to the display signal line $FRP_1$ and an output terminal electrically coupled to the second display signal line $xFRP_1$. With this configuration, the inverted display signal can be supplied to the second display signal line $xFRP_1$.

Figure 7:
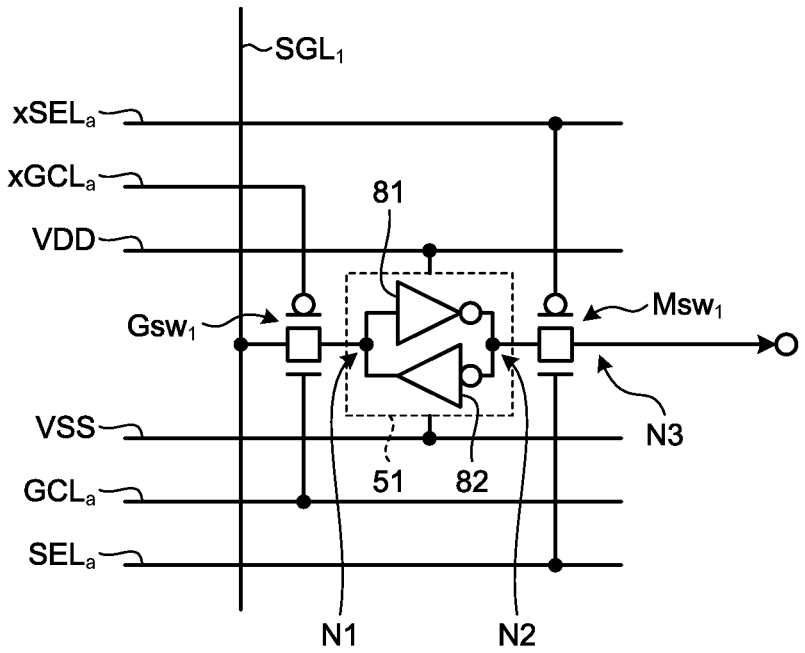
FIG. 7 is a diagram illustrating a circuit configuration of a memory in the sub-pixel of the display device of the embodiment.

FIG. 7 illustrates a circuit configuration of a memory in the sub-pixel SPix of the display device 1 in the first embodiment. FIG. 7 illustrates the circuit configuration of the first memory 51. The circuit configurations of the second memory 52 and the third memory 53 are identical to the circuit configuration of the first memory 51, and illustration and description thereof are therefore omitted.

The first memory 51 has a static random access memory (SRAM) cell structure that includes an inverter circuit 81 and another inverter circuit 82. The inverter circuit 82 is electrically coupled to the inverter circuit 81 in parallel thereto and in a direction opposite to the direction thereof. The input terminal of the inverter circuit 81 and the output terminal of the inverter circuit 82 constitute a node N1, and the output terminal of the inverter circuit 81 and the input terminal of the inverter circuit 82 constitute a node N2. The inverter circuits 81 and 82 operate with power supplied from a high-potential power supply line VDD and a low-potential power supply line VSS.

The node N1 is electrically coupled to the output terminal of the switch $Gsw_1$. The node N2 is electrically coupled to the input terminal of the switch $Msw_1$.

FIG. 7 illustrates an example in which a transfer gate is used as the switch $Gsw_1$. One control input terminal of the switch $Gsw_1$ is electrically coupled to the first gate line $GCL_a$. The other control input terminal of the switch $Gsw_1$ is electrically coupled to the fourth gate line $xGCL_a$. The fourth gate line $xGCL_a$ is supplied with the inverted gate signal obtained by inverting the gate signal supplied to the first gate line $GCL_a$.

The input terminal of the switch $Gsw_1$ is electrically coupled to the source line $SGL_1$. The output terminal of the switch $Gsw_1$ is electrically coupled to the node N1. When the gate signal supplied to the first gate line $GCL_a$ is high-level and the inverted gate signal supplied to the fourth gate line $xGCL_a$ is low-level, the switch $Gsw_1$ is turned on and electrically couples the source line $SGL_1$ to the node N1. Thus, the sub-pixel data supplied to the source line $SGL_1$ is stored in the first memory 51.

FIG. 7 illustrates an example in which a transfer gate is used as the switch $Msw_1$. One control input terminal of the switch $Msw_1$ is electrically coupled to the first memory selection line $SEL_a$. The other control input terminal of the switch $Msw_1$ is electrically coupled to the fourth memory selection line $xSEL_a$. The fourth memory selection line $xSEL_a$ is supplied with the inverted memory selection signal obtained by inverting the memory selection signal supplied to the first memory selection line $SEL_a$.

The input terminal of the switch $Msw_1$ is electrically coupled to the node N2. The output terminal of the switch $Msw_1$ is electrically coupled to a node N3. The node N3 is an output node of the first memory 51 and is electrically coupled to the inversion switch 61 (see FIG. 6). When the memory selection signal supplied to the first memory selection line $SEL_a$ is high-level and the inverted memory selection signal supplied to the fourth memory selection line $xSEL_a$ is low-level, the switch $Msw_1$ is turned on. Thus, the node N2 is electrically coupled to the input terminal of the inversion switch 61 via the switch $Msw_1$ and the node N3. Thus, the sub-pixel data stored in the first memory 51 is supplied to the inversion switch 61.

When the switches $Gsw_1$ and $Msw_1$ are both off, the sub-pixel data circulates through a loop formed by the inverter circuits 81 and 82. The first memory 51 consequently keeps holding the sub-pixel data.

While the above description illustrates the first memory 51 as an SRAM in the first embodiment, the present disclosure is not limited to this example. Other examples of the first memory 51 include, but are not limited to, a dynamic random access memory (DRAM).

Figure 8:
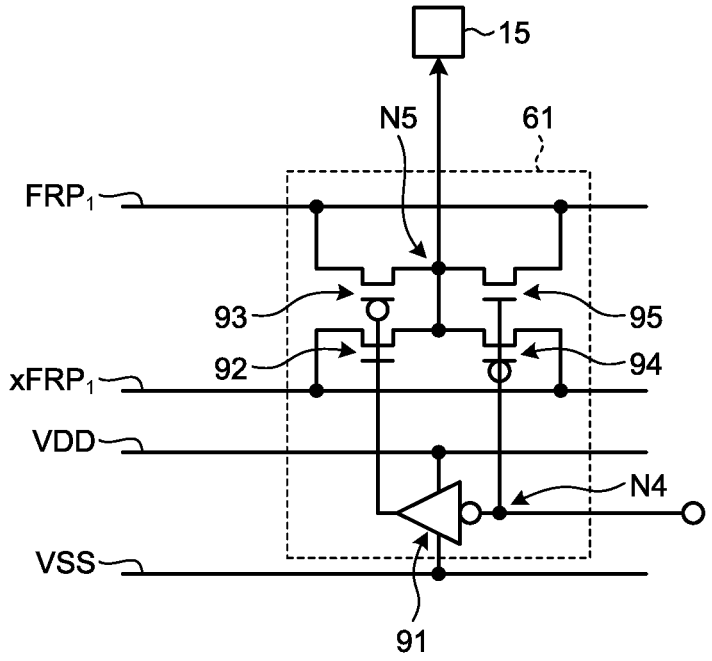
FIG. 8 is a diagram illustrating a circuit configuration of an inversion switch in the sub-pixel of the display device of the embodiment.

FIG. 8 illustrates a circuit configuration of the inversion switch 61 in the sub-pixel SPix of the display device 1 in the embodiment. The inversion switch 61 includes an inverter circuit 91, N-channel transistors 92 and 95, and P-channel transistors 93 and 94.

The input terminal of the inverter circuit 91, the gate terminal of the P-channel transistor 94, and the gate terminal of the N-channel transistor 95 are coupled to a node N4. The node N4 is an input node of the inversion switch 61 and is electrically coupled to the nodes N3 of the first memory 51, the second memory 52, and the third memory 53. The sub-pixel data is supplied to the node N4 from the first memory 51, the second memory 52, and the third memory 53. The inverter circuit 91 operates with power supplied from the high-potential power supply line VDD and the low-potential power supply line VSS.

One of the source and the drain of the N-channel transistor 92 is electrically coupled to the second display signal line $xFRP_1$. The other one of the source and the drain of the N-channel transistor 92 is electrically coupled to a node N5.

One of the source and the drain of the P-channel transistor 93 is electrically coupled to the display signal line $FRP_1$. The other one of the source and the drain of the P-channel transistor 93 is electrically coupled to the node N5.

One of the source and the drain of the P-channel transistor 94 is electrically coupled to the second display signal line $xFRP_1$. The other one of the source and the drain of the P-channel transistor 94 is electrically coupled to the node N5.

One of the source and the drain of the N-channel transistor 95 is electrically coupled to the display signal line $FRP_1$. The other one of the source and the drain of the N-channel transistor 95 is electrically coupled to the node N5.

The node N5 is the output node of the inversion switch 61 and is electrically coupled to the reflective electrode (sub-pixel electrode) 15.

When the sub-pixel data supplied from the first memory 51, the second memory 52, or the third memory 53 is high-level, an output signal from the inverter circuit 91 is low-level. When an output signal from the inverter circuit 91 is low-level, the N-channel transistor 92 is off and the P-channel transistor 93 is on.

When the sub-pixel data supplied from the first memory 51, the second memory 52, or the third memory 53 is high-level, the P-channel transistor 94 is off and the N-channel transistor 95 is on.

Therefore, when the sub-pixel data supplied from the first memory 51, the second memory 52, or the third memory 53 is high-level, the display signal supplied to the display signal line $FRP_1$ is supplied to the sub-pixel electrode 15 via the P-channel transistor 93 and the N-channel transistor 95.

The display signal supplied to the display signal line $FRP_1$ inverts in synchronization with the reference clock signal CLK. The common potential supplied to the common electrode 23 also inverts in synchronization with the reference clock signal CLK and in phase with the display signal. When the display signal and the common potential are in phase with each other, no voltage is applied to the liquid crystal LQ, and the liquid crystal molecules thereof do not change in orientation. Thus, the sub-pixel displays black (enters a state not transmitting the reflected light, that is, a state not displaying colors with the color filter not transmitting the reflected light). Thus, the display device 1 can implement a common inversion driving method.

When the sub-pixel data supplied from the first memory 51, the second memory 52, or the third memory 53 is low-level, an output signal from the inverter circuit 91 is high-level. When an output signal from the inverter circuit 91 is high-level, the N-channel transistor 92 is on and the P-channel transistor 93 is off.

When the sub-pixel data supplied from the first memory 51, the second memory 52, or the third memory 53 is low-level, the P-channel transistor 94 is on and the N-channel transistor 95 is off.

Therefore, when the sub-pixel data supplied from the first memory 51, the second memory 52, or the third memory 53 is low-level, the inverted display signal supplied to the second display signal line $xFRP_1$ is supplied to the sub-pixel electrode 15 via the P-channel transistor 92 and the N-channel transistor 94.

The inverted display signal supplied to the second display signal line $xFRP_1$ inverts in synchronization with the reference clock signal CLK. The common potential supplied to the common electrode 23 varies in synchronization with the reference clock signal CLK and in opposite phase with the display signal. When the display signal and the common potential are out of phase with each other, voltage is applied to the liquid crystal LQ, and the molecules thereof change in orientation. Thus, the sub-pixel displays white (enters a state transmitting the reflected light, that is, a state displaying colors with the color filter transmitting the reflected light). Thus, the display device 1 can implement a common inversion driving method.

Figure 9:
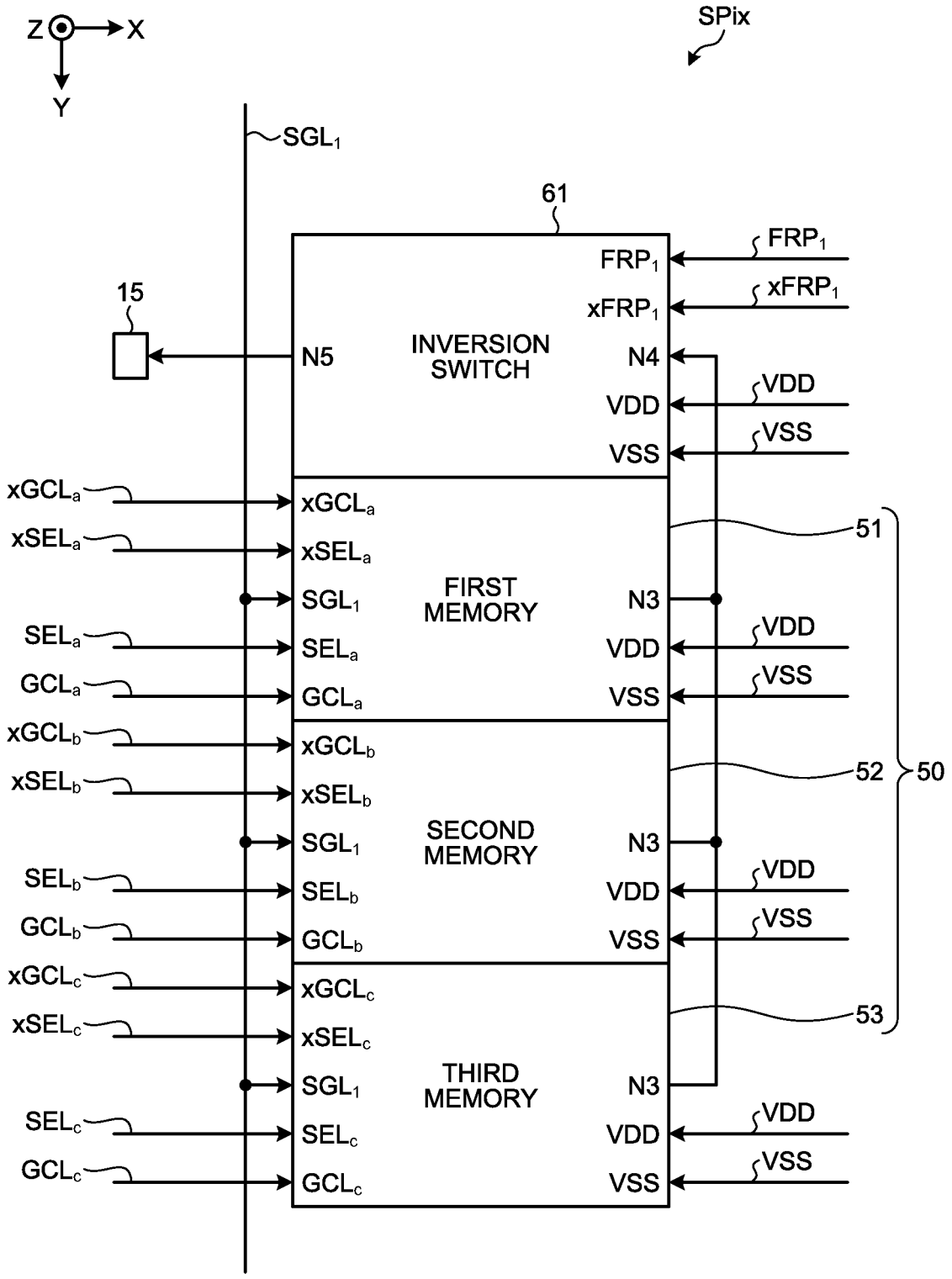
FIG. 9 is a diagram schematically illustrating a layout of the sub-pixel of the display device of the embodiment.

FIG. 9 schematically illustrates a layout in the sub-pixel SPix of the display device in the embodiment. The inversion switch 61, the first memory 51, the second memory 52, and the third memory 53 are arranged in the Y direction. The nodes N3, which are respective output nodes of the first memory 51, the second memory 52, and the third memory 53, are electrically coupled to the node N4, which is an input node of the inversion switch 61. The node N5, which is an output node of the inversion switch 61, is electrically coupled to the sub-pixel electrode 15.

The first memory 51 is electrically coupled to the first gate line $GCL_a$, the fourth gate line $xGCL_a$, the first memory selection line $SEL_a$, the fourth memory selection line $xSEL_a$, the source line $SGL_1$, the high-potential power supply line VDD, and the low-potential power supply line VSS.

The second memory 52 is electrically coupled to the second gate line $GCL_b$, the fifth gate line $xGCL_b$, the second memory selection line $SEL_b$, the fifth memory selection line $xSEL_b$, the source line $SGL_1$, the high-potential power supply line VDD, and the low-potential power supply line VSS.

The third memory 53 is electrically coupled to the third gate line $GCL_c$, the sixth gate line $xGCL_c$, the third memory selection line $SEL_c$, the sixth memory selection line $xSEL_c$, the source line $SGL_1$, the high-potential power supply line VDD, and the low-potential power supply line VSS.

The inversion switch 61 is electrically coupled to the display signal line $FRP_1$, the second display signal line $xFRP_1$, the high-potential power supply line VDD, and the low-potential power supply line VSS.

Memory Selection Control Circuit of Comparative Example

Figure 10:
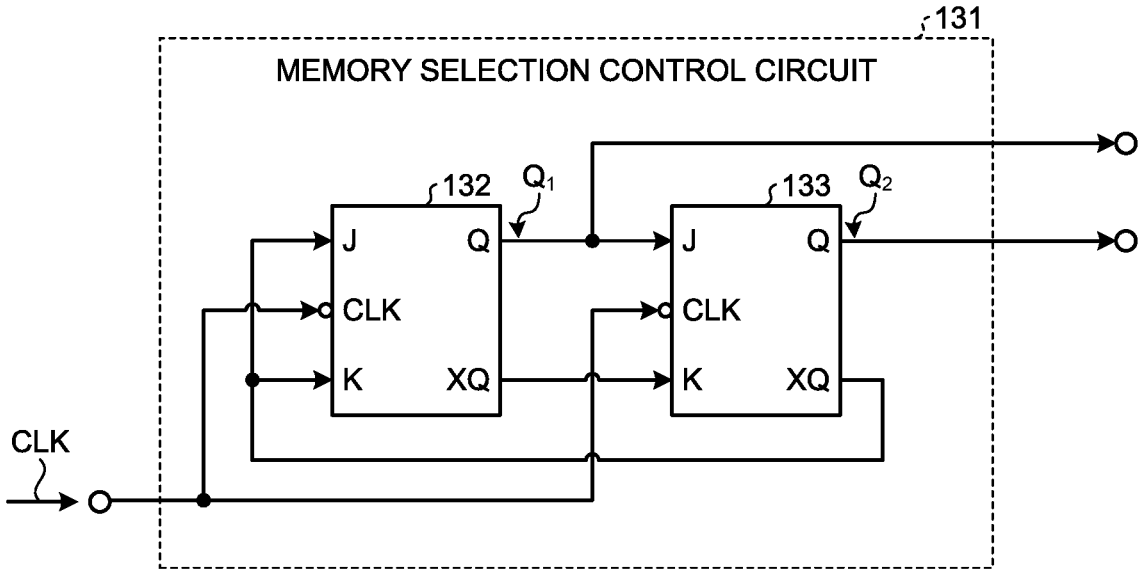
FIG. 10 is a diagram illustrating a configuration of a memory selection control circuit of a comparative example.

FIG. 10 is a diagram illustrating a configuration of a memory selection control circuit of a comparative example. A memory selection control circuit 131 of the comparative example is a ternary counter. The memory selection control circuit 131 includes first and second JK flip flops 132 and 133.

A reference clock signal CLK is supplied to clock input terminals CLK of the first and second JK flip flops 132 and 133. A signal XQ output from an inverted output terminal XQ of the second JK flip flop 133 is supplied to a first input terminal J and a second input terminal K of the first JK flip flop 132. A signal Q output from a non-inverted output terminal Q of the first JK flip flop 132 is supplied to a first input terminal J of the second JK flip flop 133. A signal XQ output from an inverted output terminal XQ of the first JK flip flop 132 is supplied to a second input terminal K of the second JK flip flop 133.

The signal Q output from the non-inverted output terminal Q of the first JK flip flop 132 is the low-order bit $Q_1$ of a memory selection control signal Q. The signal Q output from the non-inverted output terminal Q of the second JK flip flop 133 is the high-order bit $Q_2$ of the memory selection control signal Q.

Figure 11:
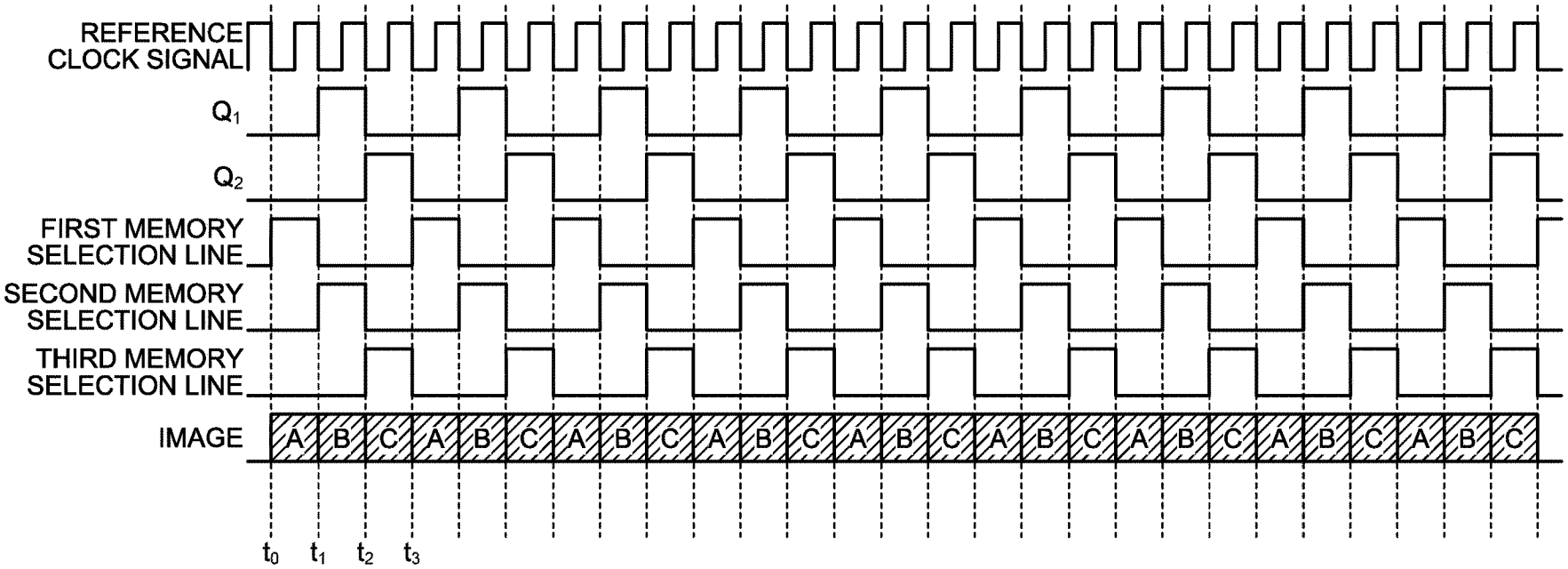
FIG. 11 is a timing chart illustrating operation timings of the memory selection control circuit of the comparative example.

FIG. 11 is a timing chart illustrating operation timings of the memory selection control circuit of the comparative example.

At timing $t_0$, when the reference clock signal CLK falls, the memory selection control circuit 131 outputs the memory selection control signal Q of "0b00" to the output circuit 35. Upon receiving the memory selection control signal Q of "0b00", the output circuit 35 outputs the memory selection signal to the first memory selection line $SEL_a$. Each of the sub-pixels SPix modulates the liquid crystal layer based on the sub-pixel data stored in the first memory 51 when the memory selection signal is supplied to the first memory selection line $SEL_a$.

Consequently, an image (frame) of "A" is displayed on a display surface.

At timing $t_1$, when the reference clock signal CLK falls, the memory selection control circuit 131 outputs the memory selection control signal Q of "0b01" to the output circuit 35. Upon receiving the memory selection control signal Q of "0b01", the output circuit 35 outputs the memory selection signal to the second memory selection line $SEL_b$. Each of the sub-pixels SPix modulates the liquid crystal layer based on the sub-pixel data stored in the second memory 52 when the memory selection signal is supplied to the second memory selection line $SEL_b$. Consequently, an image (frame) of "B" is displayed on the display surface.

At timing $t_2$, when the reference clock signal CLK falls, the memory selection control circuit 131 outputs a memory selection control signal Q of "0b10" to the output circuit 35. Upon receiving the memory selection control signal Q of "0b10", the output circuit 35 outputs the memory selection signal to the third memory selection line $SEL_c$. Each of the sub-pixels SPix modulates the liquid crystal layer based on the sub-pixel data stored in the third memory 53 when the memory selection signal is supplied to the third memory selection line $SEL_c$. Consequently, an image (frame) of "C" is displayed on the display surface.

Operation that the memory selection control circuit 131 performs from timing $t_3$ is the same as operation that it performs from timing $t_0$ to timing $t_3$. The description thereof is therefore omitted.

Figure 12:
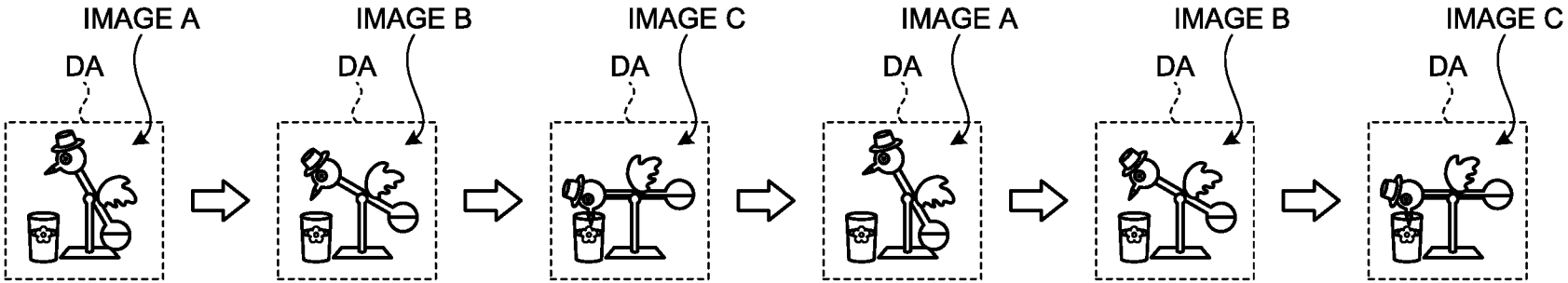
FIG. 12 is a diagram illustrating an image displayed in a display region by the memory selection control circuit of the comparative example.

FIG. 12 is a diagram illustrating an image displayed in a display region by the memory selection control circuit of the comparative example.

As illustrated in FIG. 12, the memory selection control circuit 131 can repeatedly display images of "A", "B", and "C" in the display region DA in this sequence. However, the memory selection control circuit 131 of the comparative example cannot display the images of "A", "B", and "C" in the display region DA in a different sequence.

Memory Selection Control Circuit of Embodiment

Figure 13:
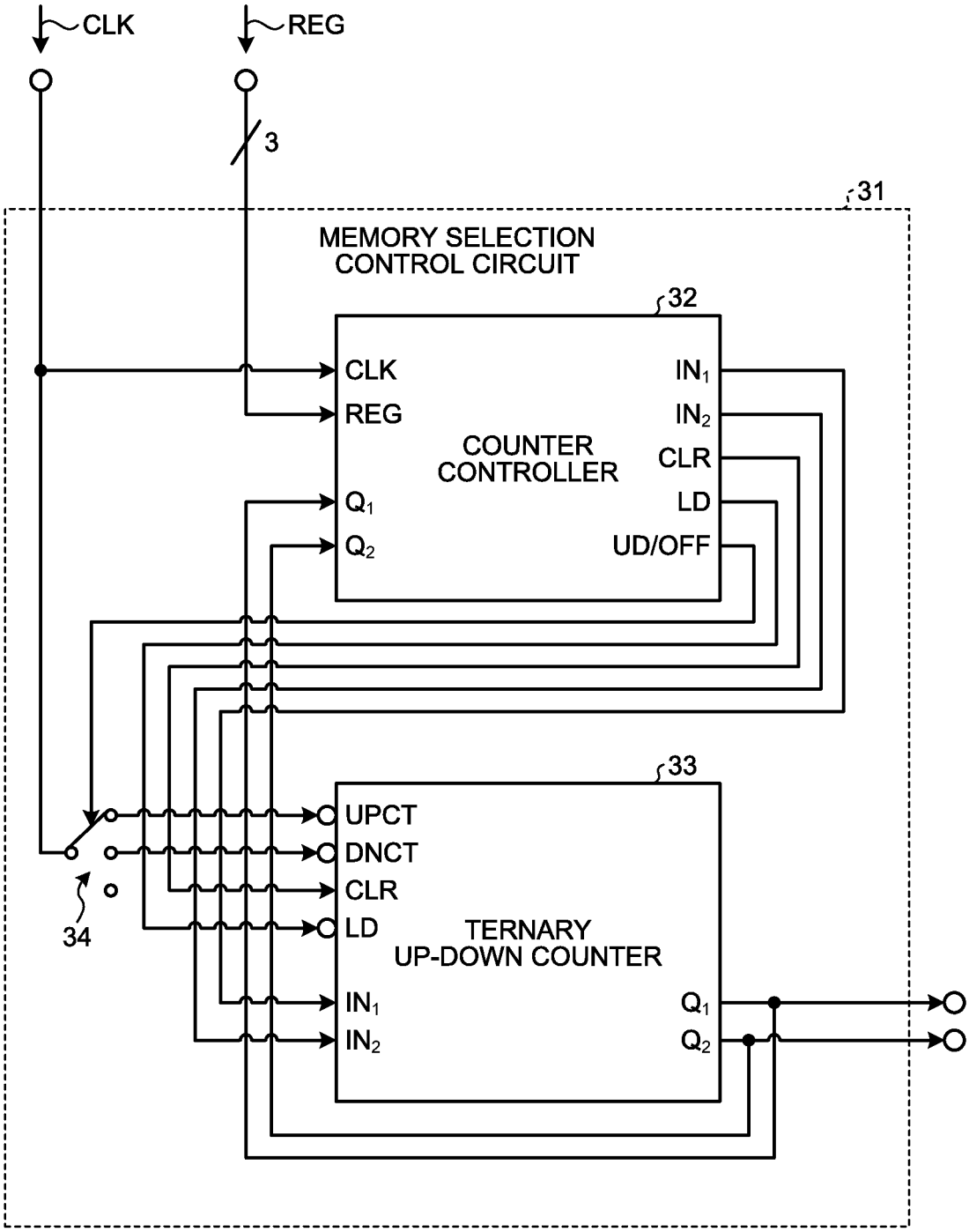
FIG. 13 is a diagram illustrating a configuration of a memory selection control circuit of the embodiment.

FIG. 13 is a diagram illustrating a configuration of the memory selection control circuit of the embodiment.

The memory selection control circuit 31 of the embodiment includes a counter controller 32 and a ternary up-down counter 33. The counter controller 32 is a sequential circuit and can be implemented by use of a flip flop or the like. The ternary up-down counter 33 is a ternary counter capable of counting up and counting down. The ternary up-down counter 33 outputs the memory selection control signal Q, which is a count value. The memory selection control signal Q is composed of a high-order bit $Q_2$ and a low-order bit $Q_1$.

The reference clock signal CLK is supplied to the clock input terminal CLK of the counter controller 32. The memory selection control value REG is supplied to the memory selection control value input terminal REG of the counter controller 32. The counter controller 32 outputs signals $IN_2$, $IN_1$, CLR, LD, and UD/OFF based on the value of the memory selection control value REG.

The signal (the high-order bit of the count value) $Q_2$ output from the output terminal $Q_2$ of the ternary up-down counter 33 is supplied to the input terminal $Q_2$ of the counter controller 32. The signal (the low-order bit of the count value) $Q_1$ output from the output terminal $Q_1$ of the ternary up-down counter 33 is supplied to the input terminal $Q_1$ of the counter controller 32.

The signal CLR output from a clearing-signal output terminal CLR of the counter controller 32 is supplied to a clearing input terminal CLR of the ternary up-down counter 33. The ternary up-down counter 33 clears the memory selection control signal Q to a predetermined value when a high-level signal CLR is supplied to the clearing input terminal CLR. While the embodiment describes the predetermined value as being "0b00", the present disclosure is not limited to this specific example.

The signal $IN_2$ output from the output terminal $IN_2$ of the counter controller 32 is supplied to an input terminal $IN_2$ of the ternary up-down counter 33. The signal $IN_1$ output from the output terminal $IN_1$ of the counter controller 32 is supplied to an input terminal $IN_1$ of the ternary up-down counter 33. The signal LD output from a load output terminal LD of the counter controller 32 is supplied to a load-inverted output terminal LD of the ternary up-down counter 33. The ternary up-down counter 33 loads the value of the signals $IN_2$ and $IN_1$ when the low-level signal LD is supplied to the load-inverted output terminal LD. The ternary up-down counter 33 then sets the memory selection control signal Q (the count value) to the value of the signals $IN_2$ and $IN_1$.

The signal UD/OFF output from the output terminal UD/OFF of the counter controller 32 is input to a control terminal of a switch 34. When the signal UD/OFF is a first value, the switch 34 outputs the reference clock signal CLK to an up-count inverted-input terminal UPCT of the ternary up-down counter 33. The ternary up-down counter 33 counts up to increment the count value on a falling edge of the reference clock signal CLK supplied to the up-count inverted-input terminal UPCT.

When the signal UD/OFF is a second value, the switch 34 outputs the reference clock signal CLK to a down-count inverted-input terminal DNCT of the ternary up-down counter 33. The ternary up-down counter 33 counts down decrementing the count value on a falling edge of the reference clock signal CLK supplied to the down-count inverted-input terminal DNCT.

When the signal UD/OFF is a third value, the switch 34 outputs the reference clock signal CLK to neither the up-count inverted-input terminal UPCT nor the down-count inverted-input terminal DNCT of the ternary up-down counter 33. In this case, the ternary up-down counter 33 neither counts up nor counts down and maintains the current count value.

FIG. 14 is a diagram illustrating a truth table of the ternary up-down counter of the display device of the embodiment.

The first row of a truth table 42 indicates how the ternary up-down counter 33 operates when: the signal LD is high-level; the signal CLR is low-level; and the reference clock signal CLK supplied to the up-count inverted-input terminal UPCT falls. In this case, the ternary up-down counter 33 counts up. As illustrated in FIG. 13, when the reference clock signal CLK is supplied to the up-count inverted-input terminal UPCT, the down-count inverted-input terminal DNCT assumes a high impedance. The present disclosure is not limited to this specific example, and it is only necessary not to concurrently supply the reference clock signal CLK to the up-count inverted-input terminal UPCT and the down-count inverted-input terminal DNCT. That is, the down-count inverted-input terminal DNCT may have been pulled up or pulled down.

The second row of the truth table 42 indicates how the ternary up-down counter 33 operates when: the signal LD is high-level; the signal CLR is low-level; and the reference clock signal CLK supplied to the down-count inverted-input terminal DNCT falls. In this case, the ternary up-down counter 33 counts down. As illustrated in FIG. 13, when the reference clock signal CLK is supplied to the down-count inverted-input terminal DNCT, the up-count inverted-input terminal UPCT assumes a high impedance. The present disclosure is not limited to this specific example, and it is only necessary not to concurrently supply the reference clock signal CLK to the up-count inverted-input terminal UPCT and the down-count inverted-input terminal DNCT. That is, the up-count inverted-input terminal UPCT may have been pulled up or pulled down.

The third row of the truth table 42 indicates how the ternary up-down counter 33 operates when the signal LD is low-level and the signal CLR is low-level. In this case, the ternary up-down counter 33 loads the signals $IN_1$ and $IN_2$. The ternary up-down counter 33 then sets the memory selection control signal Q (the count value) to the value of the signals $IN_1$ and $IN_2$. In this case, the reference clock signal CLK supplied to the up-count inverted-input terminal UPCT and the down-count inverted-input terminal DNCT constitutes a don't care condition.

The fourth row of the truth table 42 indicates how the ternary up-down counter 33 operates when the signal CLR is high-level. In this case, the ternary up-down counter 33 clears the memory selection control signal Q to "0b00". In this case, the signal LD and the reference clock signal CLK supplied to the up-count inverted-input terminal UPCT and the down-count inverted-input terminal DNCT constitute don't care conditions.

FIG. 15 is a diagram illustrating a truth table of the counter controller of the display device of the embodiment.

The first row of a truth table 43 indicates how the counter controller 32 operates when the memory selection control value REG is "0b000". In this case, the counter controller 32 outputs the signal UD/OFF of the third value to the switch 34. Upon receiving the signal UD/OFF of the third value, the switch 34 outputs the reference clock signal CLK to neither the up-count inverted-input terminal UPCT nor the down-count inverted-input terminal DNCT of the ternary up-down counter 33. The reference clock signal CLK is supplied to neither the up-count inverted-input terminal UPCT nor the down-count inverted-input terminal DNCT. Thus, the ternary up-down counter 33 neither counts up nor counts down and maintains the current value of the memory selection control signal Q.

The second row of the truth table 43 indicates how the counter controller 32 operates when the memory selection control value REG is "0b001". In this case, the counter controller 32 controls the ternary up-down counter 33 such that the first memory 51 is selected. Specifically, the counter controller 32 outputs signals $IN_2$ and $IN_1$ of "0b00", outputs a low-level signal LD, and outputs a low-level signal CLR. As illustrated in the third row of the truth table 42 (see FIG. 14), the ternary up-down counter 33 loads the value "0b00" of the signals $IN_2$ and $IN_1$. The ternary up-down counter 33 then sets the memory selection control signal Q (the count value) to the value "0b00" of the signals $IN_2$ and $IN_1$. The output circuit 35 outputs the memory selection signal to the first memory selection line $SEL_a$ as illustrated in the first row of the truth table 41 (see FIG. 5). Each of the sub-pixels SPix displays an image based on the sub-pixel data stored in the first memory 51 when the memory selection signal is supplied to the first memory selection line $SEL_a$.

The third row of the truth table 43 indicates how the counter controller 32 operates when the memory selection control value REG is "0b010". In this case, the counter controller 32 controls the ternary up-down counter 33 such that the second memory 52 is selected. Specifically, the counter controller 32 outputs signals $IN_2$ and $IN_1$ of "0b01", outputs a low-level signal LD, and outputs a low-level signal CLR. As illustrated in the third row of the truth table 42 (see FIG. 14), the ternary up-down counter 33 loads the value "0b01" of the signals $IN_2$ and $IN_1$. The ternary up-down counter 33 then sets the memory selection control signal Q (the count value) to the value "0b01" of the signals $IN_2$ and $IN_1$. The output circuit 35 outputs the memory selection signal to the second memory selection line $SEL_b$ as illustrated in the second row of the truth table 41 (see FIG. 5). Each of the sub-pixels SPix displays an image based on the sub-pixel data stored in the second memory 52 when the memory selection signal is supplied to the second memory selection line $SEL_b$.

The fourth row of the truth table 43 indicates how the counter controller 32 operates when the memory selection control value REG is "0b011". In this case, the counter controller 32 controls the ternary up-down counter 33 such that the third memory 53 is selected. Specifically, the counter controller 32 outputs the signals $IN_2$ and $IN_1$ of "0b10", outputs a low-level signal LD, and outputs a low-level signal CLR. As illustrated in the third row of the truth table 42 (see FIG. 14), the ternary up-down counter 33 loads the value "0b10" of the signals $IN_2$ and $IN_1$. The ternary up-down counter 33 then sets the memory selection control signal Q (the count value) to the value "0b10" of the signals $IN_2$ and $IN_1$. The output circuit 35 outputs the memory selection signal to the third memory selection line $SEL_c$ as illustrated in the third row of the truth table 41 (see FIG. 5). Each of the sub-pixels SPix displays an image based on the sub-pixel data stored in the third memory 53 when the memory selection signal is supplied to the third memory selection lines $SEL_c$.

The fifth row of the truth table 43 indicates how the counter controller 32 operates when the memory selection control value REG is "0b100". In this case, the counter controller 32 controls the ternary up-down counter 33 such that the ternary up-down counter 33 counts up. Specifically, the counter controller 32 outputs a high-level signal LD and outputs a low-level signal CLR. At the same time, the counter controller 32 outputs the signal UD/OFF of the first value. Upon receiving the signal UD/OFF of the first value, the switch 34 outputs the reference clock signal CLK to the up-count inverted-input terminal UPCT of the ternary up-down counter 33. As illustrated in the first row of the truth table 42 (see FIG. 14), the ternary up-down counter 33 counts up on a falling edge of the reference clock signal CLK supplied to the up-count inverted-input terminal UPCT. The ternary up-down counter 33 is ternary and therefore counts up . . . , "0b00", "0b01", "0b10", "0b00", . . . .

The sixth row of the truth table 43 indicates how the counter controller 32 operates when the memory selection control value REG is "0b101". In this case, the counter controller 32 controls the ternary up-down counter 33 such that the ternary up-down counter 33 counts down. Specifically, the counter controller 32 outputs a high-level signal LD and outputs a low-level signal CLR. At the same time, the counter controller 32 outputs the signal UD/OFF of the second value. Upon receiving the signal UD/OFF of the second value, the switch 34 outputs the reference clock signal CLK to the down-count inverted-input terminal DNCT of the ternary up-down counter 33. As illustrated in the second row of the truth table 42 (see FIG. 14), the ternary up-down counter 33 counts down on a falling edge of the reference clock signal CLK supplied to the down-count inverted-input terminal DNCT. The ternary up-down counter 33 is ternary and therefore counts down . . . , "0b00", "0b10", "0b01", "0b00", . . . .

The seventh row of the truth table 43 indicates how the counter controller 32 operates when the memory selection control value REG is "0b110". In this case, the counter controller 32 controls the ternary up-down counter 33 to repeatedly execute counting up and counting down alternately. Specifically, the counter controller 32 outputs a high-level signal LD and outputs a low-level signal CLR. At the same time, the counter controller 32 outputs the signal UD/OFF of the first value. Upon receiving the signal UD/OFF of the first value, the switch 34 outputs the reference clock signal CLK to the up-count inverted-input terminal UPCT of the ternary up-down counter 33. As illustrated in the first row of the truth table 42 (see FIG. 14), the ternary up-down counter 33 counts up on a falling edge of the reference clock signal CLK supplied to the up-count inverted-input terminal UPCT.

When the value of the signals $Q_2$ and $Q_1$ becomes "0b10", the counter controller 32 outputs a high-level signal LD and outputs a low-level signal CLR. At the same time, the counter controller 32 outputs the signal UD/OFF of the second value. Upon receiving the signal UD/OFF of the second value, the switch 34 outputs the reference clock signal CLK to the down-count inverted-input terminal DNCT of the ternary up-down counter 33. As illustrated in the second row of the truth table 42 (see FIG. 14), the ternary up-down counter 33 counts down on a falling edge of the reference clock signal CLK supplied to the down-count inverted-input terminal DNCT.

When the value of the signals $Q_2$ and $Q_1$ becomes "0b00", the counter controller 32 outputs a high-level signal LD and outputs a low-level signal CLR. At the same time, the counter controller 32 outputs the signal UD/OFF of the first value. Upon receiving the signal UD/OFF of the first value, the switch 34 outputs the reference clock signal CLK to the up-count inverted-input terminal UPCT of the ternary up-down counter 33. As illustrated in the first row of the truth table 42 (see FIG. 14), the ternary up-down counter 33 counts up on a falling edge of the reference clock signal CLK supplied to the up-count inverted-input terminal UPCT.

The counter controller 32 repeatedly executes the above control. Thus, counting up and counting down the value of the signals $Q_2$ and $Q_1$ are alternately repeated as "0b00", "0b01", "0b10", "0b01", "0b00", "0b01", . . . .

In the above description, the counter controller 32 controls the ternary up-down counter 33 so that counting up and counting down can be alternately performed with the value of the signals $Q_2$ and $Q_1$ in the range from "0b00" to "0b10". However, the present disclosure is not limited to this specific example.

The counter controller 32 may control the ternary up-down counter 33 so that counting up and counting down can be alternately performed with the value of the signals $Q_2$ and $Q_1$ in the range from "0b00" to "0b01". In this case, the output circuit 35 alternately outputs the memory selection signal to the first memory selection line $SEL_a$ and the second memory selection line $SEL_b$. The plurality of sub-pixel SPix alternately displays a first image (frame) based on the sub-pixel data stored in the first memory 51 and a second image based on the sub-pixel data stored in the second memory 52.

The counter controller 32 may control the ternary up-down counter 33 so that counting up and counting down can be alternately performed with the value of the signals $Q_2$ and $Q_1$ in the range from "0b01" to "0b10". In this case, the output circuit 35 alternately outputs the memory selection signal to the second memory selection line $SEL_b$ and the third memory selection line $SEL_c$. The plurality of sub-pixels SPix alternately display the second image based on the sub-pixel data stored in the second memories 52 and a third image based on the sub-pixel data stored in the third memories 53.

The counter controller 32 may control the ternary up-down counter 33 so that counting up and counting down can be alternately performed with the value of the signals $Q_2$ and $Q_1$ in the range from "0b10" to "0b00". In this case, the output circuit 35 alternately outputs the memory selection signal to the third memory selection line $SEL_c$ and the first memory selection line $SEL_a$. The plurality of sub-pixels SPix alternately display the third image based on the sub-pixel data stored in the third memories 53 and the first image based on the sub-pixel data stored in the first memories 51.

The range of the signals $Q_2$ and $Q_1$ in which counting up and counting down are alternately performed may be set in the setting register 4*c* and may be included in the memory selection control value REG. This allows the external circuit to dynamically set the range of the signals $Q_2$ and $Q_1$ in which counting up and counting down are alternately performed.

The eighth row of the truth table 43 indicates how the counter controller 32 operates when the memory selection control value REG is "0b111". In this case, the counter controller 32 controls the ternary up-down counter 33 so that the value of the signals $Q_2$ and $Q_1$ can be cleared to "0b00". Specifically, the counter controller 32 outputs a high-level signal CLR. As illustrated in the fourth row of the truth table 42 (see FIG. 14), the ternary up-down counter 33 clears the value of the signals $Q_2$ and $Q_1$ to "0b00".

Figure 16:
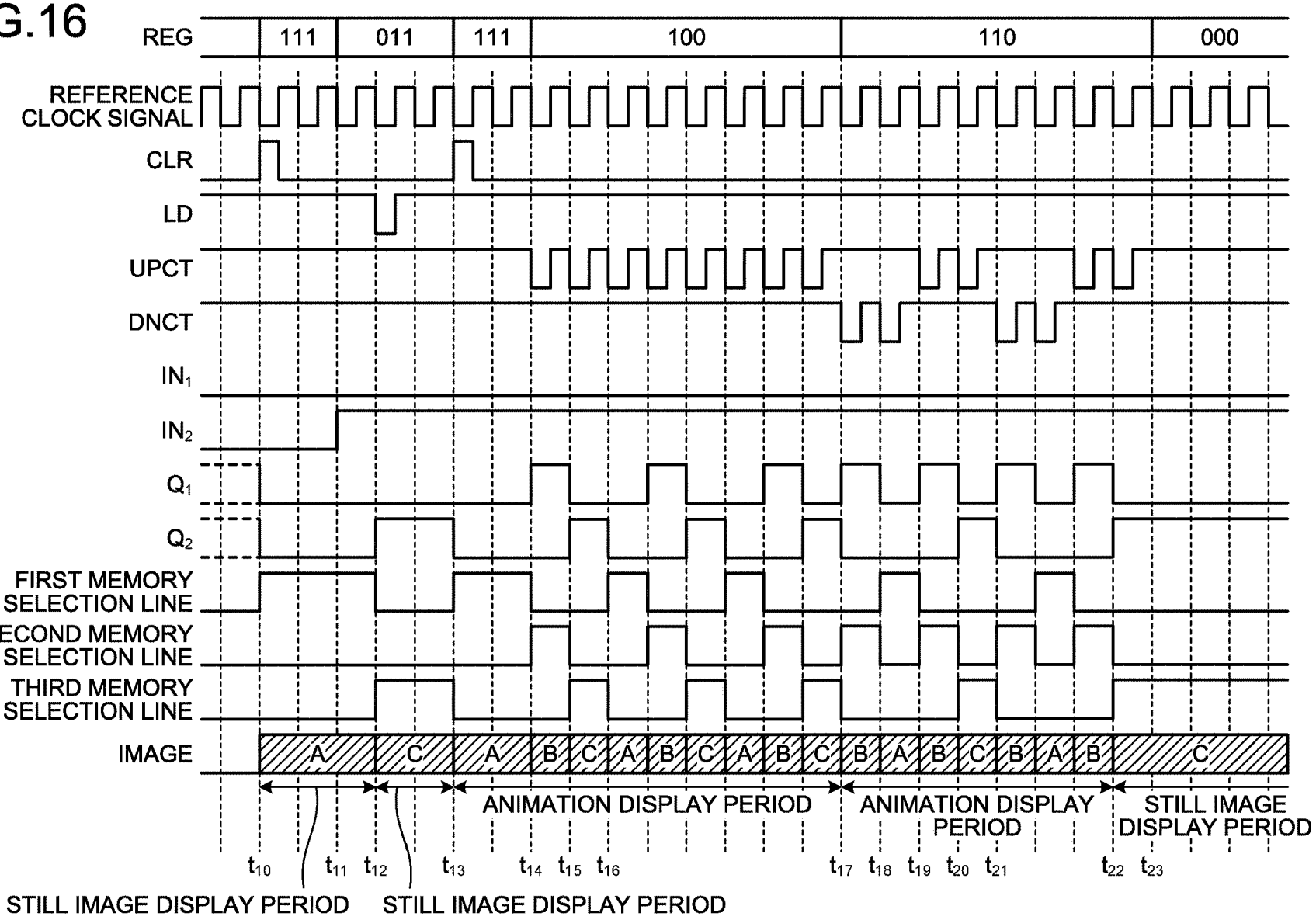
FIG. 16 is a timing chart illustrating first operation timings of the display device in the embodiment.

FIG. 16 is a timing chart illustrating first operation timings of the display device in the embodiment.

A period from timing $t_{10}$ to timing $t_{12}$ is a still image display period. At timing $t_{10}$, the external circuit writes "0b111" (clearing operation) as a memory selection control value REG in the field for memory selection in the setting register 4*c*. Upon receiving the memory selection control value REG of "0b111", the counter controller 32 outputs a high-level signal CLR. Upon receiving the high-level signal CLR, the ternary up-down counter 33 clears the value of memory selection control signal Q (high-order bit $Q_2$ and low-order bit $Q_1$ of the count value) to "0b00". Upon receiving the memory selection control signal Q of "0b00", the output circuit 35 outputs the memory selection signal to the first memory selection line $SEL_a$. The sub-pixels SPix display the image of "A" based on the sub-pixel data stored in the respective first memories 51.

At timing $t_{11}$, the external circuit writes "0b011" (third memory selection operation) as the memory selection control value REG in the field for memory selection in the setting register 4*c*. Upon receiving the memory selection control value REG of "0b011", the counter controller 32 outputs the signals $IN_2$ and $IN_1$ of "0b10".

A period from timing $t_{12}$ to timing $t_{13}$ is a still image display period. At timing $t_{12}$, the counter controller 32 outputs a low-level signal LD. Upon receiving the low-level signal LD, the ternary up-down counter 33 loads the value "0b10" of the signals $IN_2$ and $IN_1$. The ternary up-down counter 33 then sets the memory selection control signal Q to the value "0b10" of the signals $IN_2$ and $IN_1$. Upon receiving the memory selection control signal Q of "0b10", the output circuit 35 outputs the memory selection signal to the third memory selection line $SEL_c$. The sub-pixels SPix display the image of "C" based on the sub-pixel data stored in the respective third memories 53.

A period from timing $t_{13}$ to timing $t_R$y is an animation display (moving image display) period for which images of "A", "B", and "C" are repeatedly displayed in this sequence At timing $t_{13}$, the external circuit writes "0b111" (clearing operation) as a memory selection control value REG in the field for memory selection in the setting register 4*c*. Upon receiving the memory selection control value REG of "0b111", the counter controller 32 outputs a high-level signal CLR. Upon receiving the high-level signal CLR, the ternary up-down counter 33 clears the value of the memory selection control signal Q to "0b00". Upon receiving the memory selection control signal Q of "0b00", the output circuit 35 outputs the memory selection signal to the first memory selection line $SEL_a$. The sub-pixels SPix display the image of "A" based on the sub-pixel data stored in the respective first memories 51.

At timing $t_{14}$, the external circuit writes "0b100" (counting-up operation) as the memory selection control value REG in the field for memory selection in the setting register 4*c*. Upon receiving the memory selection control value REG of "0b100", the counter controller 32 outputs the signal UD/OFF of the first value to the switch 34. Upon receiving the signal UD/OFF of the first value, the switch 34 outputs the reference clock signal CLK to the up-count inverted-input terminal UPCT of the ternary up-down counter 33. Upon receiving the falling edge of the reference clock signal CLK, the ternary up-down counter 33 increments the value of the memory selection control signal Q from "0b00" to "0b01". Upon receiving the memory selection control signal Q of "0b01", the output circuit 35 outputs the memory selection signal to the second memory selection line $SEL_b$. The sub-pixels SPix display the image of "B" based on the sub-pixel data stored in the respective second memories 52.

Upon receiving a falling edge of the reference clock signal CLK at timing $t_{15}$, the ternary up-down counter 33 increments the value of the memory selection control signal Q from "0b01" to "0b10". Upon receiving the memory selection control signal Q of "0b10", the output circuit 35 outputs the memory selection signal to the third memory selection line $SEL_c$. The sub-pixels SPix display the image of "C" based on the sub-pixel data stored in the respective third memories 53.

Upon receiving a falling edge of the reference clock signal CLK at timing $t_{16}$, the ternary up-down counter 33 increments the value of the memory selection control signal Q from "0b10" to "0b00". Upon receiving the memory selection control signal Q of "0b00", the output circuit 35 outputs the memory selection signal to the first memory selection line $SEL_a$. The sub-pixels SPix display the image of "A" based on the sub-pixel data stored in the respective first memories 51.

Operation that the individual components perform during a period from timing $t_{16}$ to timing $t_{17}$ is the same as operation that these components perform during a period from timing $t_{13}$ to timing $t_{16}$. The description thereof is therefore omitted.

For a period from timing $t_{13}$ to timing $t_{17}$, as illustrated in FIG. 12 described above, the display device 1 can perform animation display in which the images of "A", "B", and "C" are repeatedly displayed in this sequence.

A period from timing $t_{17}$ to timing $t_{22}$ is an animation display (moving image display) period for which images of "C", "B", "A", "B", "C", "B", "A", . . . are repeatedly displayed in this sequence.

At timing $t_{17}$, the external circuit writes "0b110" (operation of alternately performing counting up and counting down) as the memory selection control value REG in the field for memory selection in the setting register 4*c*.

With the value of the memory selection control signal Q being "0b10", the counter controller 32 outputs the signal UD/OFF of the second value to the switch 34. Upon receiving the signal UD/OFF of the second value, the switch 34 outputs the reference clock signal CLK to the down-count inverted-input terminal DNCT of the ternary up-down counter 33. Upon receiving a falling edge of the reference clock signal CLK, the ternary up-down counter 33 decrements the value of the memory selection control signal Q from "0b10" to "0b01". Upon receiving the memory selection control signal Q of "0b01", the output circuit 35 outputs the memory selection signal to the second memory selection line $SEL_b$. The sub-pixels SPix display the image of "B" based on the sub-pixel data stored in the respective second memories 52.

Upon receiving a falling edge of the reference clock signal CLK at timing $t_{18}$, the ternary up-down counter 33 decrements the value of the memory selection control signal Q from "0b01" to "0b00". Upon receiving the memory selection control signal Q of "0b00", the output circuit 35 outputs the memory selection signal to the first memory selection line $SEL_a$. The sub-pixels SPix display the image of "A" based on the sub-pixel data stored in the respective first memories 51.

At timing $t_{19}$, since the value of the memory selection control signal Q is "0b00", the counter controller 32 outputs the signal UD/OFF of the first value to the switch 34. Upon receiving the signal UD/OFF of the first value, the switch 34 outputs the reference clock signal CLK to the up-count inverted-input terminal UPCT of the ternary up-down counter 33. Upon receiving the falling edge of the reference clock signal CLK, the ternary up-down counter 33 increments the value of the memory selection control signal Q from "0b00" to "0b01". Upon receiving the memory selection control signal Q of "0b01", the output circuit 35 outputs the memory selection signal to the second memory selection line $SEL_b$. The sub-pixels SPix display the image of "B" based on the sub-pixel data stored in the respective second memories 52.

Upon receiving a falling edge of the reference clock signal CLK at timing $t_{20}$, the ternary up-down counter 33 increments the value of the memory selection control signal Q from "0b01" to "0b10". Upon receiving the memory selection control signal Q of "0b10", the output circuit 35 outputs the memory selection signal to the third memory selection line $SEL_c$. The sub-pixels SPix display the image of "C" based on the sub-pixel data stored in the respective third memories 53.

Operation that the individual components perform during a period from timing $t_{21}$ to timing $t_{22}$ is the same as operation that these components perform during a period from timing $t_{17}$ to timing $t_{21}$. The description thereof is therefore omitted.

At timing $t_{23}$, the external circuit writes "0b000" (maintaining the current status) as the memory selection control value REG in the field for memory selection in the setting register 4*c*. The counter controller 32 outputs signal UD/OFF to the switch 34. Upon receiving the signal UD/OFF, the switch 34 outputs the reference clock signal CLK to neither the up-count inverted-input terminal UPCT nor the down-count inverted-input terminal DNCT of the ternary up-down counter 33. The reference clock signal CLK is supplied to neither the up-count inverted-input terminal UPCT nor the down-count inverted-input terminal DNCT. Thus, the ternary up-down counter 33 neither counts up nor counts down and maintains the current value "0b10" of the memory selection control signal Q. With the memory selection control signal Q being "0b10", the output circuit 35 outputs the memory selection signal to the third memory selection line $SEL_c$. The sub-pixels SPix display the image of "C" based on the sub-pixel data stored in the respective third memories 53.

In a period from timing $t_{13}$ to timing $t_{17}$, as illustrated in FIG. 12 described above, the display device 1 can perform animation display in which the images of "A", "B", and "C" are repeatedly displayed in this sequence.

Figure 17:
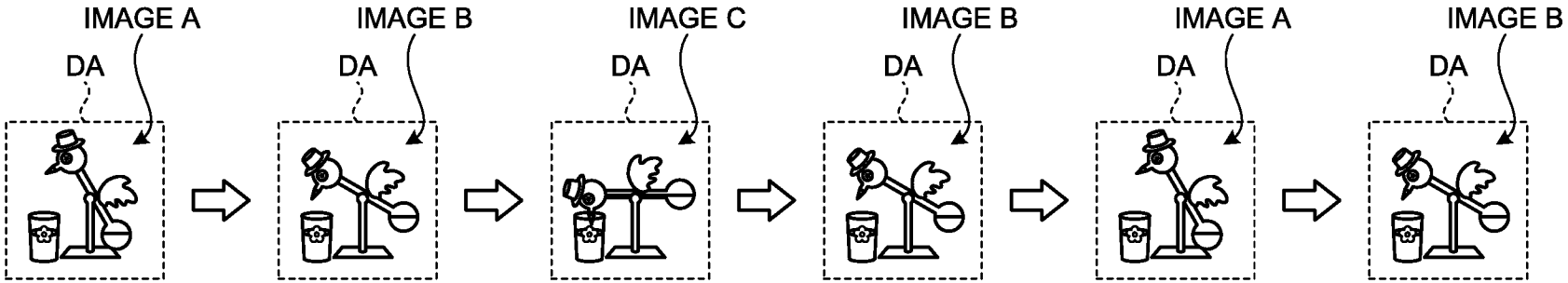
FIG. 17 is a diagram illustrating images displayed by the display device of the embodiment.

FIG. 17 is a diagram illustrating images displayed by the display device of the embodiment.

As illustrated in FIG. 17, the display device 1 can repeatedly display images of "A", "B", "C", "B", "A", "B", . . . in this sequence.

Referring again to FIG. 16, a still image display period starts from timing $t_{22}$. At timing $t_{22}$, the external circuit writes "0b000" (current-state maintaining operation) as the memory selection control value REG in the field for memory selection in the setting register 4*c*. Upon receiving the memory selection control value REG of "0b000", the counter controller 32 outputs the signal UD/OFF of the third value to the switch 34. Upon receiving the signal UD/OFF of the third value, the switch 34 outputs the reference clock signal CLK to neither the up-count inverted-input terminal UPCT nor the down-count inverted-input terminal DNCT of the ternary up-down counter 33. The reference clock signal CLK is supplied to neither the up-count inverted-input terminal UPCT nor the down-count inverted-input terminal DNCT. Thus, the ternary up-down counter 33 neither counts up nor counts down and maintains the current value "0b10" of the memory selection control signal Q. Upon receiving the memory selection control signal Q of "0b10", the output circuit 35 outputs the memory selection signal to the third memory selection line $SEL_c$. The sub-pixels SPix display the image of "C" based on the sub-pixel data stored in the respective third memories 53.

Figure 18:
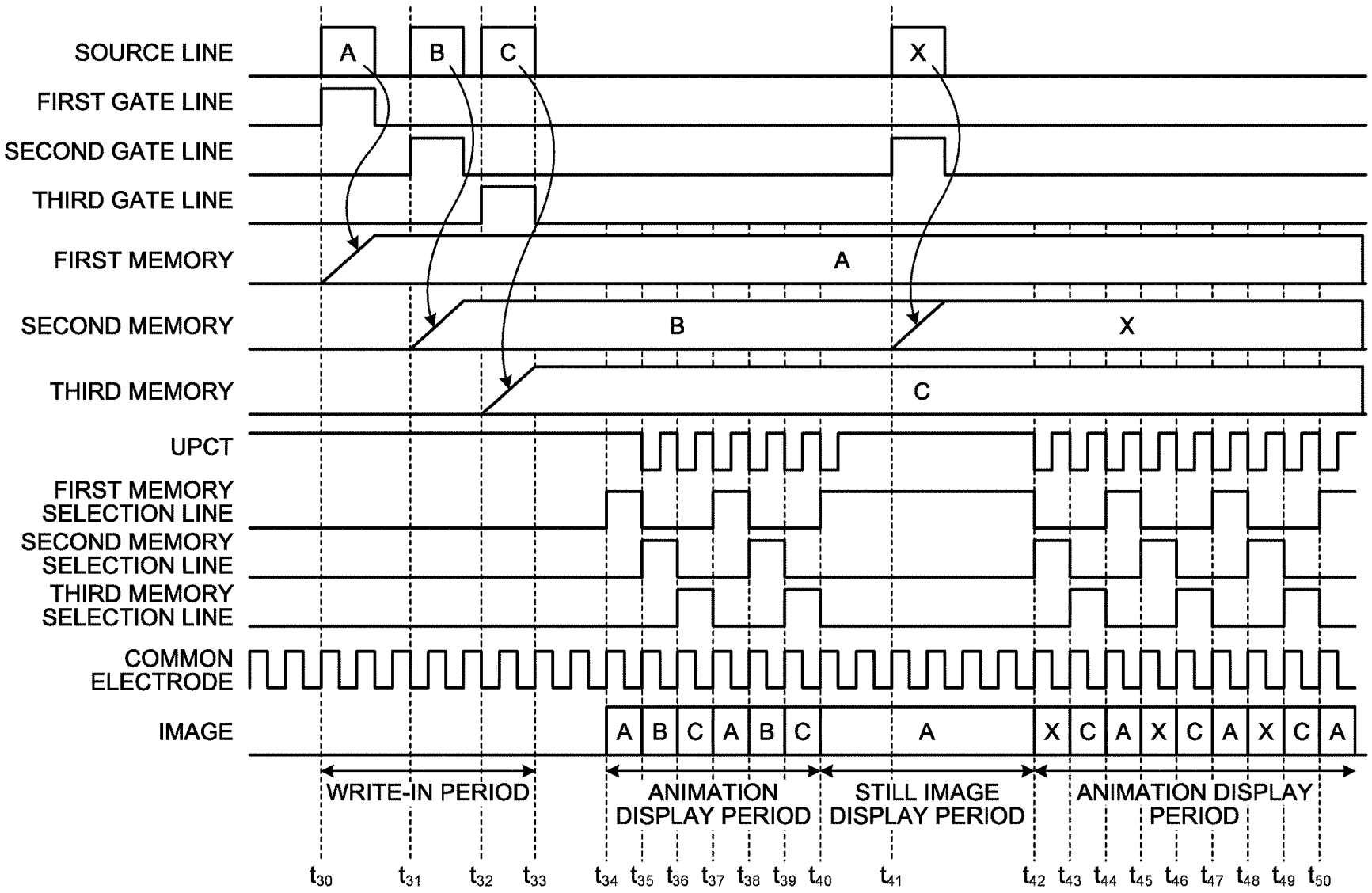
FIG. 18 is a timing chart illustrating second operation timings of the display device of the embodiment.

FIG. 18 is a timing chart illustrating second operation timings of the display device in the embodiment.

Throughout the entire period in FIG. 18, the common-electrode drive circuit 6 supplies, to the common electrode 23, a common potential that inverts in synchronization with the reference clock signal CLK.

A period from timing $t_{30}$ to timing $t_{33}$ is a write-in period in which to write the sub-pixel data into the first memory 51 to the third memory 53 included in each of the N×3 sub-pixels SPix of one of the rows.

At timing $t_{30}$, the timing controller 4*b* outputs the control signal $Sig_5$ of the first value to the switch $SW_4$ in the gate line selection circuit 10. The switch $SW_4$ electrically couples together the output terminal of the gate line drive circuit 9 and the first gate line $GCL_a$. The gate line drive circuit 9 outputs a gate signal to the first gate line $GCL_a$ of each of the rows. When a high-level gate signal is supplied to the first gate line $GCL_a$, the first memories 51 of the respective sub-pixels SPix that belong to the row are selected as memories into which the sub-pixel data are to be written.

At timing $t_{30}$, the source line drive circuit 5 outputs sub-pixel data for displaying an image (frame) of "A" to the source lines SGL. Thus, the sub-pixel data for displaying the image (frame) of "A" is written into the first memories 51 in the respective sub-pixels SPix that belong to each row.

For a period from timing $t_{30}$ to timing $t_{31}$, the same operation is performed line-sequentially on each row from the first row to the M-th row. Thus, signals for forming the image "A" are written into and stored in the first memories in all of the sub-pixels SPix.

At timing $t_{31}$, the timing controller 4*b* outputs the control signal $Sig_5$ of the second value to the switch $SW_4$ in the gate line selection circuit 10. The switch $SW_4$ electrically couples together the output terminal of the gate line drive circuit 9 and the second gate line $GCL_b$. The gate line drive circuit 9 outputs a gate signal to the second gate line $GCL_b$ of each of the rows. When a high-level gate signal is supplied to the second gate line $GCL_b$, the second memories 52 of the respective sub-pixels SPix that belong to the row are selected as memories into which the sub-pixel data are to be written.

At timing $t_{31}$, the source line drive circuit 5 outputs sub-pixel data for displaying an image (frame) of "B" to the source lines SGL. Thus, the sub-pixel data for displaying the image (frame) of "B" are written into the second memories 52 in the respective sub-pixels SPix that belong to each row.

For a period from timing $t_{31}$ to timing $t_{32}$, the same operation is performed line-sequentially on each row from the first row to the M-th row. Thus, the signal for forming the image of "B" is written into and stored in the second memories in all of the sub-pixels SPix.

At timing $t_{32}$, the timing controller 4*b* outputs the control signal $Sig_5$ of the third value to the switch $SW_4$ in the gate line selection circuit 10. The switch $SW_4$ electrically couples together the output terminal of the gate line drive circuit 9 and the third gate line $GCL_c$. The gate line drive circuit 9 outputs a gate signal to the third gate line $GCL_c$ of each of the rows. When a high-level gate signal is supplied to the third gate line $GCL_c$, the third memories 53 of the respective sub-pixels SPix that belong to the row are selected as memories into which the sub-pixel data are to be written.

At timing $t_{32}$, the source line drive circuit 5 outputs sub-pixel data for displaying an image (frame) of "C" to the source lines SGL. Thus, the sub-pixel data for displaying the image of "C" are written in the third memories 53 of the respective sub-pixels SPix that belong to each row.

For a period from timing $t_{32}$ to timing $t_{33}$, the same operation is performed line-sequentially on each row from the first row to the M-th row. Thus, signals for forming the image of "C" are written into and stored in the third memories in all of the sub-pixels SPix.

By repeating the same operation from timing $t_{30}$ to timing $t_{33}$ M times, the display device 1 can write sub-pixel data for displaying the three images of "A", "B", and "C" in the first memory 51 to third memory 53 included in each sub-pixel SPix.

A period from timing $t_{34}$ to timing $t_{40}$ is an animation display (moving image display) period for which the three images (three frames) of "A", "B", and "C" are repeatedly displayed in this sequence.

At timing $t_{34}$, the external circuit writes "0b111" (clearing operation) as the memory selection control value REG in the field for memory selection in the setting register 4*c*. Upon receiving the memory selection control value REG of "0b111", the counter controller 32 outputs a high-level signal CLR. Upon receiving the high-level signal CLR, the ternary up-down counter 33 clears the value of the memory selection control signal Q to "0b00". Upon receiving the memory selection control signal Q of "0b00", the output circuit 35 outputs the memory selection signal to the first memory selection line $SEL_a$. The sub-pixels SPix display the image of "A" based on the sub-pixel data stored in the respective first memories 51.

At timing $t_{35}$, the external circuit writes "0b100" (counting-up operation) as the memory selection control value REG in the field for memory selection in the setting register 4*c*. Upon receiving the memory selection control value REG of "0b100", the counter controller 32 outputs the signal UD/OFF of the first value to the switch 34. Upon receiving the signal UD/OFF of the first value, the switch 34 outputs the reference clock signal CLK to the up-count inverted-input terminal UPCT of the ternary up-down counter 33. Upon receiving the falling edge of the reference clock signal CLK, the ternary up-down counter 33 increments the value of the memory selection control signal Q from "0b00" to "0b01". Upon receiving the memory selection control signal Q of "0b01", the output circuit 35 outputs the memory selection signal to the second memory selection line $SEL_b$. The sub-pixels SPix display the image of "B" based on the sub-pixel data stored in the respective second memories 52.

Upon receiving a falling edge of the reference clock signal CLK at timing $t_{36}$, the ternary up-down counter 33 increments the value of the memory selection control signal Q from "0b01" to "0b10". Upon receiving the memory selection control signal Q of "0b10", the output circuit 35 outputs the memory selection signal to the third memory selection line $SEL_c$. The sub-pixels SPix display the image of "C" based on the sub-pixel data stored in the respective third memories 53.

Upon receiving a falling edge of the reference clock signal CLK at timing $t_{37}$, the ternary up-down counter 33 increments the value of the memory selection control signal Q from "0b10" to "0b00". Upon receiving the memory selection control signal Q of "0b00", the output circuit 35 outputs the memory selection signal to the first memory selection line $SEL_a$. The sub-pixels SPix display the image of "A" based on the sub-pixel data stored in the respective first memories 51.

Operation that the individual components perform during a period from timing $t_{37}$ to timing $t_{40}$ is the same as operation that these components perform during a period from timing $t_{34}$ to timing $t_{37}$. The description thereof is therefore omitted.

For a period from timing $t_{34}$ to timing $t_{40}$, as illustrated in FIG. 12 described above, the display device 1 can perform animation display in which the images of "A", "B", and "C" are repeatedly displayed in this sequence.

A period from timing $t_{40}$ to timing $t_{42}$ is a still image display period for which the image of "A" is displayed.

Upon receiving a falling edge of the reference clock signal CLK at timing $t_{40}$, the ternary up-down counter 33 increments the value of the memory selection control signal Q from "0b10" to "0b00". Upon receiving the memory selection control signal Q of "0b00", the output circuit 35 outputs the memory selection signal to the first memory selection line $SEL_a$. The sub-pixels SPix display the image of "A" based on the sub-pixel data stored in the respective first memories 51. Thereafter, the external circuit writes "0b000" (current-state maintaining operation) as the memory selection control value REG in the field for memory selection in the setting register 4*c*. Upon receiving the memory selection control value REG of "0b000", the counter controller 32 outputs the signal UD/OFF of the third value to the switch 34. Upon receiving the signal UD/OFF of the third value, the switch 34 outputs the reference clock signal CLK to neither the up-count inverted-input terminal UPCT nor the down-count inverted-input terminal DNCT of the ternary up-down counter 33. The reference clock signal CLK is supplied to neither the up-count inverted-input terminal UPCT nor the down-count inverted-input terminal DNCT. Thus, the ternary up-down counter 33 neither counts up nor counts down and maintains the current value "0b00" of the memory selection control signal Q. Upon receiving the memory selection control signal Q of "0b00", the output circuit 35 outputs the memory selection signal to the first memory selection line $SEL_a$. The sub-pixels SPix displays the image of "A" as a still image based on the sub-pixel data stored in the respective first memories 51.

At timing $t_{41}$ within the still image display period for which the image of "A" is displayed as a still image, sub-pixel data for displaying an image (frame) of "X" can be written into the second memory 52 included in each sub-pixel SPix.

At timing $t_{41}$, the timing controller 4*b* outputs the control signal $Sig_5$ of the second value to the switch $SW_4$ in the gate line selection circuit 10. The switch $SW_4$ electrically couples together the output terminal of the gate line drive circuit 9 and the second gate line $GCL_b$.

The gate line drive circuit 9 outputs a gate signal to the second gate line $GCL_b$ of each of the rows. When a high-level gate signal is supplied to the second gate line $GCL_b$, the second memories 52 of the respective sub-pixels SPix that belong to the row are selected as memories into which the sub-pixel data are to be written.

At timing $t_{41}$, the source line drive circuit 5 outputs sub-pixel data for displaying an image (frame) of "X" to the source lines SGL. Thus, the sub-pixel data for displaying the image (frame) "X" are written into the individual second memories 52 in the sub-pixels SPix that belong to the row.

By repeating the same operation as the operation performed at timing $t_{41}$ M times, the display device 1 can write the sub-pixel data for displaying the image (frame) of "X" into the second memories 52 in the respective sub-pixels SPix.

FIG. 18 illustrates a case in which, at timing $t_{41}$ during the still-image display period for which the image of "A" is displayed as a still image, the sub-pixel data for displaying the image of "X" are written into the second memories 52 in the respective sub-pixels SPix. However, it is also possible to, for example, in a period from timing $t_{38}$ to timing $t_{38}$ for which the images of "C" and "A" are displayed as animations (displayed as moving images) in the animation display (moving image display) period, write the sub-pixel data for displaying the image of "X" into the second memories 52 in the respective sub-pixels SPix.

A period from timing $t_{42}$ is an animation display period for which the three images of "X", "C", and "A" are repeatedly displayed in this sequence.

At timing $t_{42}$, the external circuit writes "0b100" (counting-up operation) as the memory selection control value REG in the field for memory selection in the setting register 4*c*. Upon receiving the memory selection control value REG of "0b100", the counter controller 32 outputs the signal UD/OFF of the first value to the switch 34. Upon receiving the signal UD/OFF of the first value, the switch 34 outputs the reference clock signal CLK to the up-count inverted-input terminal UPCT of the ternary up-down counter 33. Upon receiving the falling edge of the reference clock signal CLK, the ternary up-down counter 33 increments the value of the memory selection control signal Q from "0b00" to "0b01". Upon receiving the memory selection control signal Q of "0b01", the output circuit 35 outputs the memory selection signal to the second memory selection line $SEL_b$. The sub-pixels SPix displays the image of "X" based on the sub-pixel data stored in the respective second memories 52.

Upon receiving a falling edge of the reference clock signal CLK at timing $t_{43}$, the ternary up-down counter 33 increments the value of the memory selection control signal Q from "0b01" to "0b10". Upon receiving the memory selection control signal Q of "0b10", the output circuit 35 outputs the memory selection signal to the third memory selection line $SEL_c$. The sub-pixels SPix display the image of "C" based on the sub-pixel data stored in the respective third memories 53.

Upon receiving a falling edge of the reference clock signal CLK at timing $t_{44}$, the ternary up-down counter 33 increments the value of the memory selection control signal Q from "0b10" to "0b00". Upon receiving the memory selection control signal Q of "0b00", the output circuit 35 outputs the memory selection signal to the first memory selection line $SEL_a$. The sub-pixels SPix display the image of "A" based on the sub-pixel data stored in the respective first memories 51.

Upon receiving a falling edge of the reference clock signal CLK at timing $t_{45}$, the ternary up-down counter 33 increments the value of the memory selection control signal Q from "0b00" to "0b01". Upon receiving the memory selection control signal Q of "0b01", the output circuit 35 outputs the memory selection signal to the second memory selection line $SEL_b$. The sub-pixels SPix display the image of "B" based on the sub-pixel data stored in the respective second memories 52.

Operation that the individual components perform from timing $t_{45}$ is the same as operation that these components perform during a period from timing $t_{42}$ to timing $t_{45}$. The description thereof is therefore omitted.

For a period from timing $t_{45}$, the display device 1 can perform animation display in which the images of "X", "C", "A", "X", "C", . . . are repeatedly displayed in this sequence.

In the display device disclosed in JP-A-H09-212140, a plurality of memories included in each of the plurality of pixels are switched from one to another by line sequential scanning using a scan signal. Therefore, in the display device disclosed in JP-A-09-212140, a one-frame period is needed for switching of the memories in all of the pixels. Therefore, a one-frame period is needed to change an image (frame) in the display device described in JP-A-09-212140.

In contrast, the display device 1 of the embodiment is configured such that the memory selection circuit 8 disposed outside the display region DA concurrently selects the first memories 51, the second memories 52, or the third memories 53 in the sub-pixels SPix. Consequently, the display device 1 can display one image (one frame) among three images (three frames) by switching selection of a memory among the first memory 51 to the third memory 53 in each of the sub-pixels SPix. Thus, the display device 1 can change images all together and can quickly change images. The display device 1 enables animation display (moving image display) by sequentially switching selection of a memory among the first memory 51 to the third memory 53 in each of the sub-pixels SPix.

In the display device disclosed in JP-A-09-212140, each pixel includes a memory selection control circuit and a rewrite instruction circuit so as to switch memories from one to another. Therefore, the display device disclosed in JP-A-H09-212140 is not capable of meeting the desire to have an image display panel more finely structured and provided with a further higher definition.

In contrast, the display device 1 of the embodiment is configured such that the gate line selection circuit 10 disposed in the frame region GD selects the first memories 51, the second memories 52, or the third memories 53 when sub-pixel data are written. The display device 1 is also configured such that the memory selection circuit 8 disposed in the frame region GD selects the first memories 51, the second memories 52, or the third memories 53 when sub-pixel data are read out. This configuration makes it unnecessary for the pixels Pix to include individual circuits for switching memories. Thus, the display device 1 can meet the demand for making image display panels further reduced in size and higher in definition.

The display device 1 of the embodiment is further capable of, during a period for which an image is displayed based on sub-pixel data stored in memories that are the first memories 51, the second memories 52, or the third memories 53, writing sub-pixel data into other memories that are the first memories 51, the second memories 52, or the third memories 53. Thus, the display device 1 can also write sub-pixel data for an image while displaying another image.

The display device 1 of the embodiment is further configured such that, based on the memory selection control value REG, the memory selection control circuit 31 sequentially outputs, to the output circuit 35, the memory selection control signal Q specifying the memory selection line SEL to which the memory selection signal is to be output. The output circuit 35 then sequentially outputs the memory selection signal to the memory selection line SEL designated by the memory selection control signal Q. Thus, the display device 1 enables animation display (moving image display) of a plurality of images based on the sub-pixel data stored in the first memories 51, the second memories 52, and the third memories 53 in various sequences.

Based on the memory selection control value REG in the setting register 4*c*, the display device 1 of the embodiment can change the sequence in which a plurality of images are to be displayed. Therefore, by changing the value of the setting register 4*c* from the external circuit, the display device 1 can change the sequence in which a plurality of images are to be displayed even while an image is being displayed. Therefore, the display device 1 can dynamically change the sequence in which a plurality of images are displayed, according to the use mode.

The display device 1 is used for an electronic shelf label in some cases. In the case of an electronic shelf label, it is desired that an image of introduction of an item, an image of the price of the item, an image of the raw material for the item, and the like be displayed in various sequences. The display device 1 can meet such a desire.

APPLICATION EXAMPLE

Figure 19:
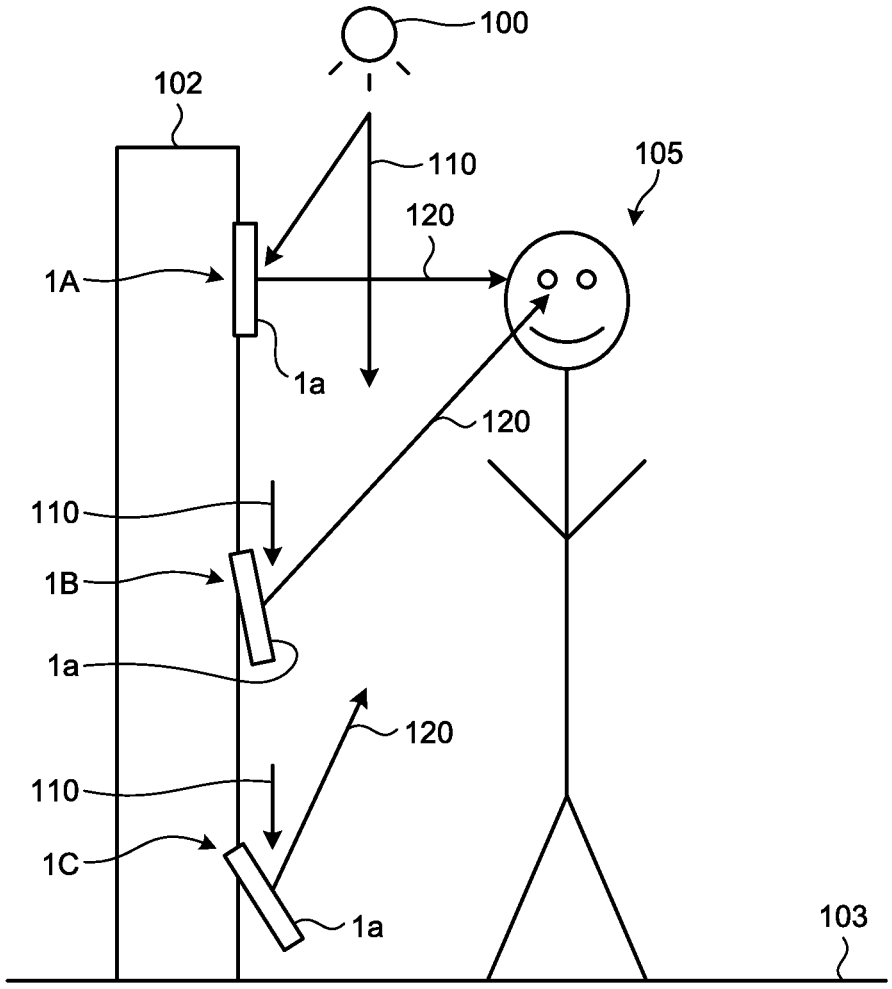
FIG. 19 is a diagram illustrating an application example of the display device of the embodiment.

FIG. 19 is a diagram illustrating an application example of the display device of the embodiment. FIG. 19 illustrates an example in which the display device 1 is applied to an electronic shelf label.

As illustrated in FIG. 19, display devices 1A, 1B, and 1C are individually attached to a shelf 102. Each of the display devices 1A, 1B, and 1C has the same configuration as the above described display device 1. The display devices 1A, 1B, and 1C are installed at different heights from a floor surface 103 and with different panel tilt angles. The panel tilt angles are formed by the normal lines of display surfaces 1*a* and the horizontal direction. The display devices 1A, 1B, and 1C reflect light 110 incident thereon from lighting equipment 100 as a light source, thereby causing images 120 to emanate toward an observer 105.

While a preferred embodiment of the present invention has been described heretofore, this embodiment is not intended to limit the present invention. Descriptions disclosed in these embodiments are merely illustrative, and can be modified variously without departing from the spirit of the present invention. Modifications made without departing from the spirit of the present invention naturally fall within the technical scope of the present invention. At least any of omission, replacement, and modification can be made in various manners to any constituent element in the above described embodiment and each of the modifications without departing from the spirit of the present invention.

What is claimed is:

1. A display device comprising:

a plurality of sub-pixels arranged in a row direction and a column direction and each including a memory block that includes a plurality of memories to store therein sub-pixel data;

a plurality of memory selection line groups provided corresponding to a plurality of rows and each including a plurality of memory selection lines electrically coupled to the memory blocks in the respective sub-pixels that belong to the corresponding row; and a memory selection circuit configured to concurrently output a memory selection signal to the memory selection line groups, the memory selection signal being a signal for selecting one of the memories in each of the memory blocks, wherein, based on a set value, the memory selection circuit selects one of the memory selection lines to be supplied with the memory selection signal in each of the memory selection line groups, wherein each of the sub-pixels displays an image based on the sub-pixel data stored in one of the memories in accordance with the memory selection line supplied with the memory selection signal, wherein the number of times that the set value is changed is less than the number of times that images are switched from one to another based on the memory selection signal output from the memory selection circuit, wherein, based on the set value, the memory selection circuit sequentially switches a memory selection line from one memory selection line to another in each of the memory selection line groups, wherein, in accordance with the sequential switching of the memory selection lines, the sub-pixels sequentially switch the image being displayed, each image being based on the sub-pixel data stored in the respective memory of each of the sub-pixels, wherein, based on the set value, the memory selection circuit sequentially switches a memory selection line from one memory selection line to another in a first sequence and then in a second sequence, in each of the memory selection line groups, and wherein, in accordance with the sequential switching in the first sequence and then in the second sequence, the sub-pixels switch the image being displayed in the first sequence and then in the second sequence.

2. The display device according to claim 1, wherein, based on the set value, the memory selection circuit sequentially outputs the memory selection signal to some of the memory selection lines in each of the memory selection line groups, and wherein, in accordance with the memory selection lines to which the memory selection signal has been sequentially supplied, some of the sub-pixels sequentially switch the image being displayed.

3. The display device according to claim 1, further comprising:

a plurality of gate line groups provided for the respective rows and each including a plurality of gate lines electrically coupled to the memory blocks in the respective sub-pixels that belong to the corresponding row;

a gate line drive circuit configured to sequentially output a gate signal to the rows in writing the sub-pixel data into the memory blocks, the gate signal being a signal for selecting one of the rows;

a plurality of source lines provided for respective columns;

a source line drive circuit configured to output a plurality of pieces of the sub-pixel data to the source lines in writing the sub-pixel data into the memory blocks; and a gate line selection circuit configured to electrically couple one of the gate lines in each of the gate line groups to the gate line drive circuit in writing the sub-pixel data into the memory blocks, wherein, each of the sub-pixels that has received the gate signal stores the sub-pixel data in one of the memories.

4. The display device according to claim 3, wherein, while displaying an image based on the sub-pixel data stored in one of the memories in accordance with the memory selection line supplied with the memory selection signal, each of the sub-pixels stores the sub-pixel data in another one of the memories in accordance with the gate line supplied with the gate signal.

5. A display device comprising:

a plurality of sub-pixels arranged in a row direction and a column direction and each including a memory block that includes a plurality of memories to store therein sub-pixel data;

a plurality of memory selection line groups provided corresponding to a plurality of rows and each including a plurality of memory selection lines electrically coupled to the memory blocks in the respective sub-pixels that belong to the corresponding row; and a memory selection circuit configured to concurrently output a memory selection signal to the memory selection line groups, the memory selection signal being a signal for selecting one of the memories in each of the memory blocks, wherein, based on a set value, the memory selection circuit selects one of the memory selection lines to be supplied with the memory selection signal in each of the memory selection line groups, wherein each of the sub-pixels displays an image based on the sub-pixel data stored in one of the memories in accordance with the memory selection line supplied with the memory selection signal, wherein the number of times that the set value is changed is less than the number of times that images are switched from one to another based on the memory selection signal output from the memory selection circuit, wherein each of the sub-pixels further includes a sub-pixel electrode, and a switch circuit located between the memory block and the sub-pixel electrode, wherein the display device further comprises a common electrode facing the sub-pixel electrodes and configured to receive a common potential, a common-electrode drive circuit configured to invert the common potential periodically in synchronization with a reference clock signal and output the inverted common potential to the common electrode, and a plurality of display signal lines, at least a pair of the display signal lines electrically coupled to one of the switch circuits, the one of the pair of the display signal lines supplying one display signal which has an in-phase potential with the common potential, the other of the pair of the display signal lines supplying another display signal which has a reverse phase potential with the common potential, and wherein the switch circuit supplies one of the display signals to the pixel electrode based on the display data input from the memory block.

* * * * *